US011497379B2

(12) United States Patent
Cerruti

(10) Patent No.: US 11,497,379 B2
(45) Date of Patent: Nov. 15, 2022

(54) WASHING AGENT DISPENSER FOR HOUSEHOLD WASHING MACHINES, IN PARTICULAR DISHWASHERS

(71) Applicant: ELTEK S.p.A., Casale Monferrato (IT)

(72) Inventor: Daniele Cerruti, Casale Monferrato (IT)

(73) Assignee: ELTEK S.p.A., Casale Monferrato (IT)

( * ) Notice: Subject to any disclaimer, the term of this patent is extended or adjusted under 35 U.S.C. 154(b) by 74 days.

(21) Appl. No.: 17/189,924

(22) Filed: Mar. 2, 2021

(65) Prior Publication Data

US 2021/0177240 A1 Jun. 17, 2021

Related U.S. Application Data

(62) Division of application No. 15/736,819, filed as application No. PCT/IB2016/053575 on Jun. 16, 2016, now Pat. No. 10,939,798.

(30) Foreign Application Priority Data

Jun. 18, 2015 (IT) ..... 102015000025196

(51) Int. Cl.
*A47L 15/44* (2006.01)

(52) U.S. Cl.
CPC ..... *A47L 15/4409* (2013.01)

(58) Field of Classification Search
CPC ..... A47L 15/44
See application file for complete search history.

(56) References Cited

U.S. PATENT DOCUMENTS 8,499,773 B2 * 8/2013 Marone ..... A47L 15/4409 134/93
2008/0295546 A1 * 12/2008 Cho ..... D06F 39/02 68/17 R

* cited by examiner

*Primary Examiner* — Jason Y Ko
(74) *Attorney, Agent, or Firm* — Nixon & Vanderhye P.C.

(57) ABSTRACT

A dishwasher washing agent dispenser includes (a) a dispenser body, configured to be set partially into an opening of an inner side of a dishwasher door and the dispenser body has a receptacle for containing a washing agent, (b) a dispenser door mounted in a guided way with respect to the dispenser body, for being slidable between positions of closing and opening of the receptacle, the open position allowing dispensing of the washing agent from the receptacle, (c) guides between the dispenser body and the dispenser door, for guiding displacement of the dispenser door between the positions of closing and opening in such a way that, when the dispenser door is open, a portion of the dispenser door projects from the dispenser body, in a substantially cantilever fashion, and (d) a supporting element extending in length downwards from the dispenser door and configured to counter bending of the portion of the dispenser door that projects from the dispenser body when the dispenser door is in the open position.

20 Claims, 14 Drawing Sheets

Fig. 11
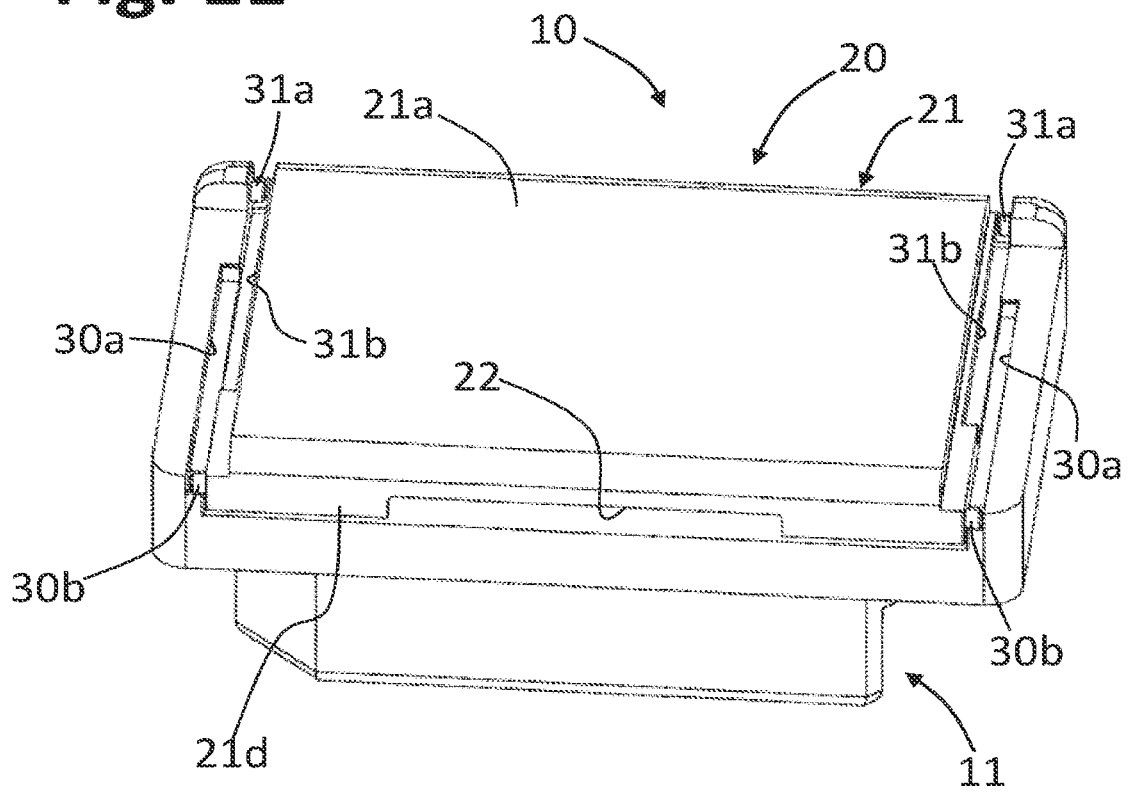
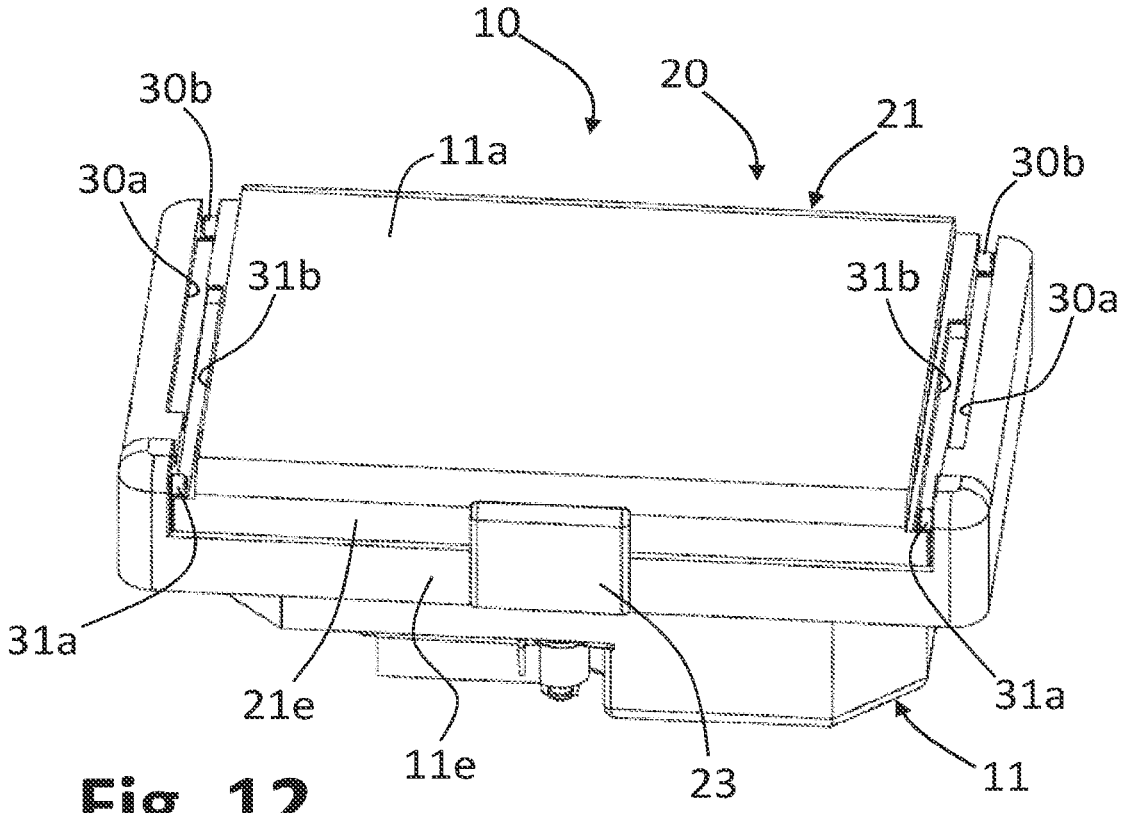
Fig. 12

WASHING AGENT DISPENSER FOR HOUSEHOLD WASHING MACHINES, IN PARTICULAR DISHWASHERS

CROSS-REFERENCE TO RELATED APPLICATIONS

This application is a divisional from U.S. application Ser. No. 15/736,819 filed 15 Dec. 2017, which is an application that is the U.S. national phase of International Application No. PCT/IB2016/053575 filed 16 Jun. 2016, which designated the U.S. and claims priority to IT Patent Application No. 102015000025196 filed 18 Jun. 2015, the entire contents of each of which are hereby incorporated by reference.

FIELD OF THE INVENTION

The present invention relates to washing agent dispensers for household washing machines, in particular dishwashers, and has been developed with particular reference to dispensers provided with at least one sliding hatch or door.

PRIOR ART

Some household washing machines, and in particular dishwashers, are equipped with a device for dispensing washing products that is configured for dispensing at least one washing agent. Generally, these devices are provided for dispensing, at different moments of one and the same dish-washing cycle, two different washing agents, typically represented by a detergent in the solid form (powder or tablets) and by a liquid rinsing additive. Also known are dispensers provided for the purposes of dispensing just one washing substance in the solid form or else in the liquid form.

In the most widespread solutions, dispensers for dishwashers comprise a main body obtained by moulding of thermoplastic material, associated to one of the vertical walls that delimit the washtub of the machine (including the internal shell of the front door of the machine that faces the inside of the washtub), which is usually at least partially set in, in a fluid-tight way, in an opening provided in the wall. Defined in the front area of the body of the dispenser is a receptacle for containing a washing agent, usually a detergent in powder or tablet form, necessary for carrying out a washing cycle. The receptacle is provided with a closing door, which also has a respective body made of plastic material. Operative between the body of the dispenser and the body of the door are elastic means, which urge the door towards a respective open position, as well as a system for blocking/release of the door. In the course of a washing cycle, opening of the aforesaid door is controlled appropriately by a programmer, or timer, of the machine, which governs an actuator forming part of the aforesaid blocking/release system. The latter is usually conceived also for enabling, with a machine not running, manual opening and the closing of the door.

In some known solutions, the body of the door is slidably constrained to the body of the dispenser so that it can slide between a closed position and an open position in a substantially linear way or else following a path that is at least in part inclined or curved: for this purpose, corresponding slide guides are provided interacting between the body of the dispenser and the body of the door. Devices of this sort are known, for example, from U.S. Pat. No. 5,884,821 A and DE102005004098 A.

A known solution, substantially of the type described in DE102005004098 A is exemplified schematically in FIGS. 1 to 6, where the dispenser is designated as a whole by 1 and where the bodies of the door and of the dispenser are designated by 2 and 3, respectively. The body 2 of the door has two opposite lateral portions or walls, constituted by walls 2*a* and 2*b* that are generally parallel to one another and to the sliding direction of the door, indicated schematically by the arrow D of FIG. 1 (in the prior document cited, the movement of the door follows a generally arched path).

The body 3 of the dispenser has two corresponding opposite lateral portions or walls 3*a* and 3*b*, which are generally parallel to one another and to the aforesaid walls 2*a* and 2*b* of the body 2 of the door, where the outer side of each of the walls 2*a* and 2*b* faces the inner side of a corresponding wall 3*a* and 3*b*. Provided at the outer side of each of the walls 2*a* and 2*b* are two projecting elements 4 or studs, set at a distance from one another in the sliding direction D, which are also defined hereinafter for simplicity as "pins". A first pin 4 is located on the respective side wall 2*a* or 2*b* in the proximity of an end thereof, i.e., near a transverse wall 2*c* of the door 2, whereas the other pin 4 is located in an intermediate area of the respective side wall 2*a* or 2*b*. Each pin 4 is slidably engaged in a respective guide groove 5 defined on the inner side of the corresponding wall 3*a* or 3*b*, where the two guide grooves 5 of each wall 3*a* or 3*b* are arranged substantially one after another in the sliding direction D.

In FIG. 2, designated moreover by 6 is a receptacle for containing an amount of washing agent, for example, a detergent in powder or tablet form, the mouth of which is delimited by a projecting annular lip 6*a*, on which a gasket, designated by 7 in FIGS. 3-4, associated to the body of the door 2, is designed to operate in a fluid-tight way. Designated by 8 is a spring, which is operative for urging the body of the door 2 towards an open position. The dispenser 1 further comprises a system for blocking/release of the door 2 (not shown).

Dispensers according to the prior art described in general present a low stability of the door 2 in the position where the receptacle for the washing agent is closed in a fluid-tight way, in particular on account of the fact that the distance between the pins 4 on each side of the door is relatively small. This distance is basically dictated by the length of the corresponding grooves 5, which in turn depends upon the dimensions of the body 3 of the dispenser.

Known solutions of the type illustrated in FIGS. 1-2 present in fact the drawback that, in the closed position of the door, an adequate thrust of the gasket 7 on the corresponding lip 6*a* of the receptacle 6 is not guaranteed. Practical tests conducted by the present applicant have, for example, made it possible to ascertain that this may give rise to leakage of liquid detergent and/or undesirable infiltration of water into the receptacle. Another drawback of the solutions of this sort is that they allow for only a relatively limited travel of opening of the door 2 from the closed position to the open position, with the anomalous consequence that, even in the open position, the receptacle 6 is not completely exposed. A reduced opening of the door could not guarantee dispensing of washing agents in the form of tablets or ones contained in a pack. Moreover, this limited opening of the door determines a reduced exposure of the receptacle to the jets of washing water, so that it is difficult for the jets of washing water to carry away the washing agent when it is in powder form and flush clean the receptacle. In the case of incomplete removal of a powdered washing agent, the resulting residue tends to stick to the receptacle and to the door, subsequently solidifying, with consequent risk of blocking of the mechanism of opening/closing of the door itself.

To clarify these aspects more fully, in FIGS. 3 and 5 the known dispenser 1 is represented in the condition of closing of the corresponding hatch or door 2, whereas in FIGS. 4 and 6 the dispenser is represented in the condition of maximum opening of the door 2. It should be noted that in the above schematic figures representation of some elements has been omitted, such as the spring 8, and (in FIGS. 5-6) the gasket 7, and the projecting lip 6*a* of the receptacle 6. In FIG. 5, as in FIG. 6, the dashed line T represents by way of example the inner side of the door of the dishwasher, provided with an opening in which the body 3 of the dispenser 1 is partially set in.

As may be noted in FIGS. 3 and 5, in the closed position of the door 2 the pins 4 are located at a first end of the respective grooves 5, in particular an end defined in an initial portion of the grooves themselves that is inclined from below upwards in the direction of sliding of the door from the closed position to the open position. The presence of these inclined stretches of the grooves 5 basically has the function of enabling the door 2—when withheld in the closed position by the blocking/release system—to assume a lowered position, in which the gasket 7 is pressed against the projecting lip 6*a* of the receptacle 6, and then enabling a slight lifting of the door 2, to allow sliding thereof towards the open position, thanks to the action of the spring 8 and after the door has been released by the blocking/release system.

In FIG. 3, the dashed lines $X_1$ and $X_2$ highlight axes passing through the pins 4 provided on the outer side of the two walls 2*a* and 2*b* of the body of the door 2. In the closed position, the action of thrust of the gasket 7 on the lip 6*a* is determined by the pins 4, which constrain the body of the door to the body of the dispenser. It will be appreciated, however, from FIG. 3 that the pins 4 that are located in an intermediate position on the walls 2*a* and 2*b* (axis $X_2$) do not enable the gasket 7 to exert a homogeneous thrust on the lip 6*a*. In particular, the portion of the gasket 7 that extends in the area comprised between the two axes $X_1$ and $X_2$ will be subject to a thrust greater than the one available on the portion of the gasket that extends outside this region (i.e., above the axis $X_2$, as viewed FIG. 3). This drawback may be inferred also from FIG. 5, even though the gasket 7 and the lip 6*a* are not highlighted therein.

When the door 2 is released by the corresponding blocking/release system, it is urged by the corresponding spring towards the open position, i.e., with a sliding of the guided elements, represented by the pins 4, along the corresponding guide elements, represented by the grooves 5. In the course of this movement, the pins 4 follow the inclined stretches of the grooves 5, thereby causing a slight raising of the door 2. The door 2 then proceeds with the movement of opening until there is the mechanical interference between the pins 4 and the second end of the grooves 5, as represented schematically in FIGS. 4 and 6. As may be seen in these figures, the known arrangement illustrated allows a relatively limited travel of the door 2 from the closed position to the open position, with the consequence that, even in the open position, the receptacle 6 is only partially open or exposed. As has been said, this can complicate dispensing of a detergent and/or its complete removal from the receptacle 6, in particular hindering dispensing or dropping into the washtub of washing agents in powder or a tablet form or in the form of packs of washing agents (such as packs of the type defined "3-in-1", "4-in-1") contained in the receptacle 6.

Apparently, this drawback could be obviated by reducing the dimensions of the receptacle; however, this limits the capacity of containment of the receptacle, not enabling filling thereof with the correct dose, or proper housing of some of the aforesaid forms of washing agents, such as tablets, which are commercially available in different shapes. A displacement of the receptacle, in order to define it completely in the area of the body 3 of the dispenser that is exposed following upon opening of the door 2, would not be possible for problems of space (from FIGS. 5 and 6 it is evident how close the receptacle already is to the outer part of the lower portion of the body 3 that is to be set in in the door of the washing machine), and in any case would complicate considerably production of the dispenser 1.

In some known dispenser devices with sliding door, not necessarily of the same type as that of DE102005004098 A, a portion of the door projects substantially in cantilever fashion from the main body of the dispenser, when it is in the open position. This may give rise to a poor stability or solidity of the door 2. Also this problem may be exemplified with reference to FIG. 6, where a portion of the open door 2 projects from the body 3 of the dispenser. In this condition, it may happen that a significant thrust, substantially as indicated by the arrow P, is accidentally exerted on this projecting portion: consider an occasional impact due, for example, to dropping on the door of a relatively heavy dish, or else consider the case where the user inadvertently rests or exerts an anomalous thrust on the door during its closing. In this eventuality, there may be caused damage to the door 2 or to its guide system due to the stresses exerted on the pins 4, even with exit of the latter from the corresponding guide grooves 5.

AIM AND SUMMARY OF THE INVENTION

The present invention is basically aimed to solve one or more of the aforesaid drawbacks of the prior art.

In accordance with a first aspect, an aim of the present invention is to provide a dispenser of washing agents that enables an increased travel of opening of a corresponding sliding door, in particular towards the outside of the profile delimited by the body of the dispenser.

According to another aspect, an aim of the present invention is to provide a dispenser of washing agents that enables proper fluid-tight closing of the corresponding door and/or an improved and distributed thrust of a gasket carried by a corresponding sliding door, with respect to the mouth of a receptacle for containing a washing agent, in particular in the case of a dispenser of washing agents with an opening of the sliding door towards the outside of the profile delimited by the body of the dispenser.

According to another aspect, an aim of the present invention is to provide a dispenser of washing agents distinguished by a good stability of movement and/or of fluid-tight closing of a corresponding sliding door, also in the case where the corresponding dispenser body is of relatively small dimensions, in particular in the case of a dispenser of washing agents with an opening of the sliding door towards the outside of the profile delimited by the body of the dispenser.

In accordance with a further aspect, an aim of the present invention is to provide a dispenser of washing agents that enables an increased stability or protection of a corresponding sliding door, when the door itself is in the open position or moves towards it.

One or more of the above aims are achieved, according to the present invention, by a dispenser of washing agents that presents, among other things, the characteristics specified also in the claims. The objects of the invention are likewise achieved by a washing machine, in particular a dishwasher, including a dispenser of this sort.

BRIEF DESCRIPTION OF THE DRAWINGS

Further objects, characteristics, and advantages of the present invention emerge clearly from the ensuing detailed description, with reference to the annexed schematic drawings, which are provided purely by way of non-limiting example and in which:

FIGS. 11 and 12 are partially sectioned perspective views, from different angles, of a dispenser of washing agents according to an embodiment of the invention;

DESCRIPTION OF PREFERRED EMBODIMENTS OF THE INVENTION

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment", "in one embodiment", and the like that may be present in various points of this description do not necessarily refer to one and the same embodiment. In the framework of this description, where not otherwise specified or when not immediately evident from the context described, terms indicating position such as "top", "bottom", "side", "initial", "final" and the like are understood to refer to the arrangement illustrated in a given figure and are in any case non-limiting. Moreover, particular configurations and/or structures and/or characteristics described may be considered individually or combined in any adequate way, in one or more embodiments, even different from the embodiments described hereinafter by way of non-limiting example. The references used in what follows are only provided for convenience and do not define the sphere of protection or the scope of the embodiments.

It is moreover pointed out that, in the present description and in the annexed claims, terms such as "inner side", when they refer to a portion, wall, or element of a dispenser body and of a door body, are understood to designate a side, a face, or a surface of that portion, wall, or element that substantially faces an intermediate area of the dispenser, for example, where a receptacle for containing a washing agent opens, this area preferably being at least partially subtended by the body of a door. With terms such as "outer side", when also these refer to a portion, wall, or element of a dispenser body and of a door body, are consequently understood as designating a side, a face, or a surface of that portion, wall, or element that are set facing in a direction generally opposite to the direction identified by the "inner side" of the same portion, wall, or element.

Figure 7:
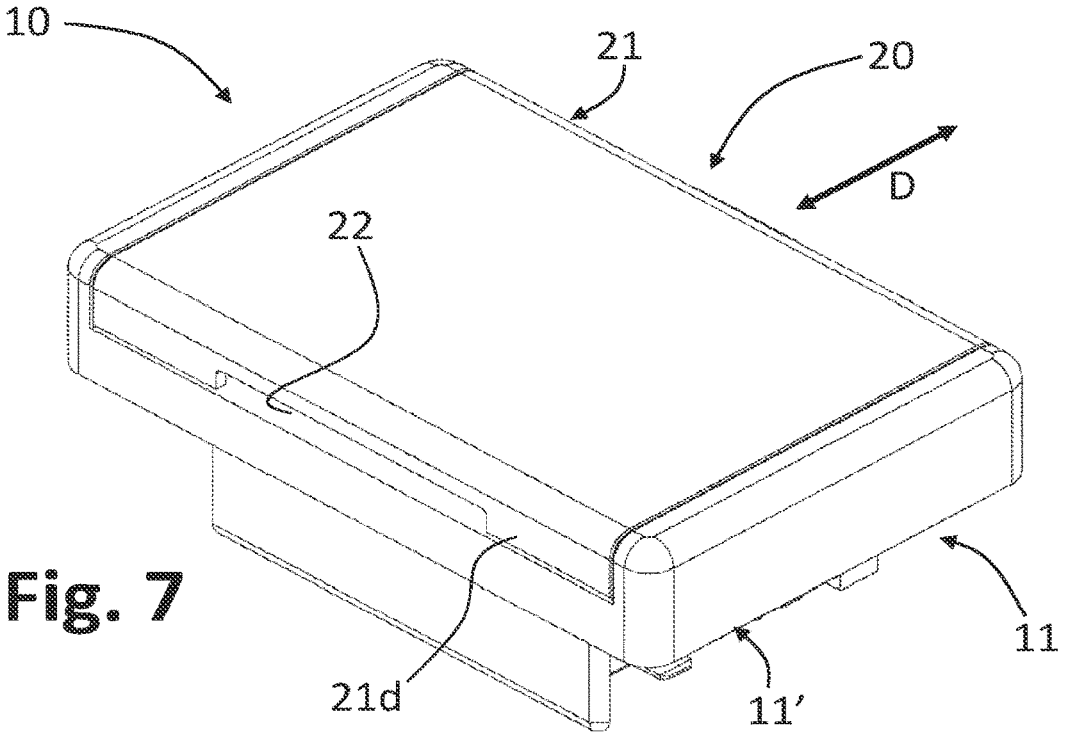
FIGS. 7 and 8 are schematic perspective views, from different angles, of a dispenser of washing agents according to an embodiment of the invention.
Figure 8:
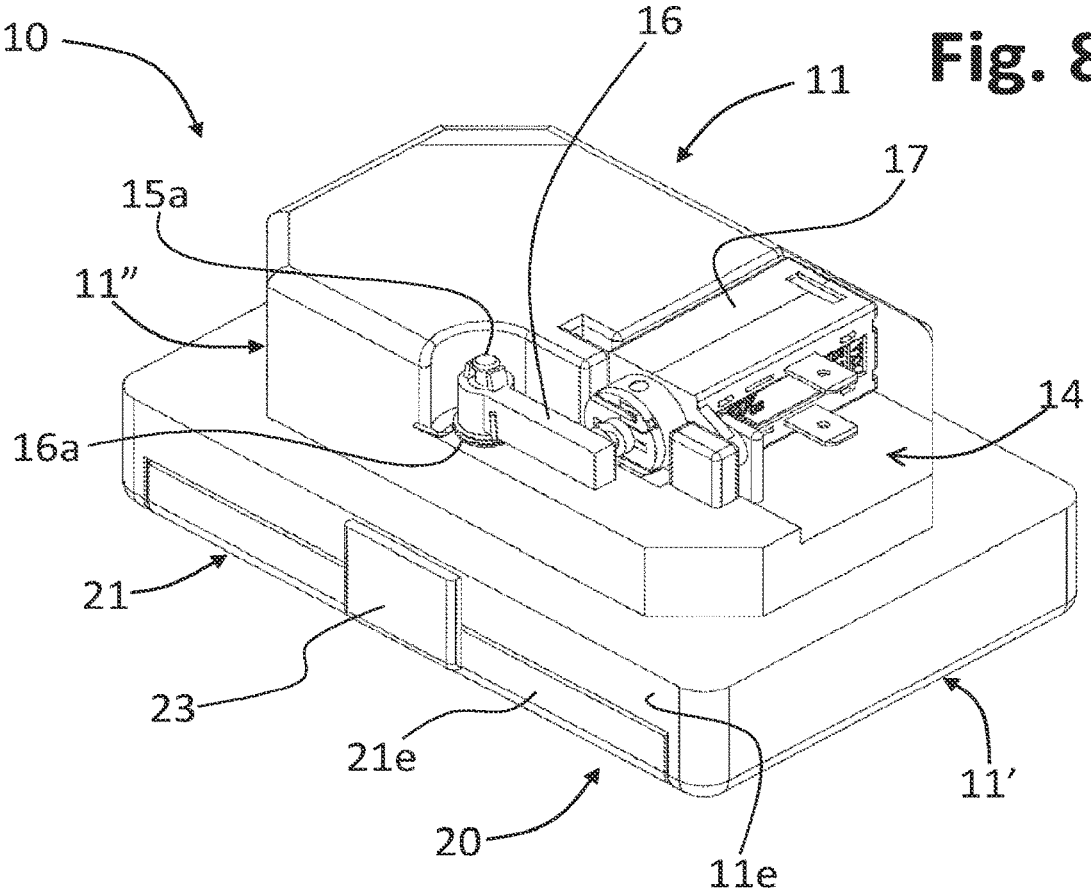

With initial reference to FIGS. 7 and 8, designated as a whole by 10 is a device for dispensing washing agents according to an embodiment of the present invention. In what follows, it is assumed that the dispenser 10 is fixed to a wall that delimits the washtub of a dish-washing machine, in particular a wall defined by the door of the machine. It should be considered, however, that the dispenser according to the invention could also be fixed to some other part of the washing machine, preferably within a washtub, such as a dispenser fixed to a dish-rack, or else a dispenser configured as component separate from the machine, but designed to be located by the user in the respective washtub.

The dispenser comprises a dispenser body 11, which is made at least in part of moulded plastic material, in particular a thermoplastic material. In the example illustrated, the dispenser body 11 comprises a front piece or part 11', designed to face or be located in a washtub, and a rear piece or part 11", preferably designed to be at least in part inserted in an opening of a wall of the tub, or fixed in some other way to a wall or other part of the machine, such as a dish-rack. For instance, in FIGS. 13 and 14 the dashed line T indicates by way of example the inner side of the door of a dishwasher, provided with an opening in which the body 3 of the dispenser 1 is partially set in; it may, however, possibly indicate a wall of a dish-rack. The parts 11' and 11" are conveniently obtained by moulding of thermoplastic material separately from one another and then joined together, for example, via welding. The dispenser 10 may in any case have parts 11', 11" obtained and shaped differently. In the sequel of the present description, generic reference will be made to the dispenser body 11, taking for granted that the characteristics that pertain to the present invention basically refer to its front part 11', which defines an upper face of the dispenser, associated to which is at least one sliding hatch or door.

Figure 9:
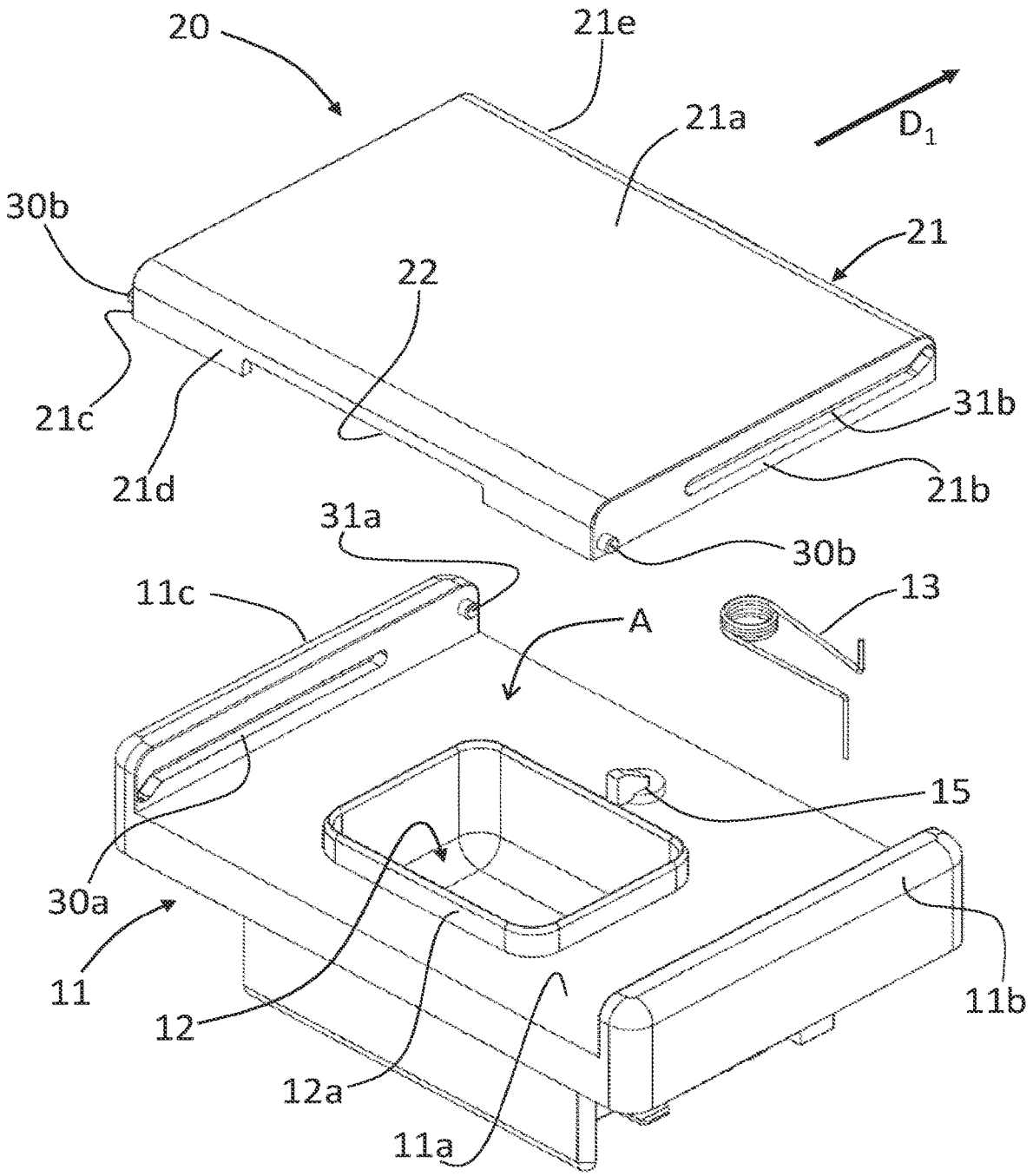
FIGS. 9 and 10 are partially exploded views, from different angles, of a dispenser of washing agents according to an embodiment of the invention.

With reference also to FIG. 9, in an area of the body of the dispenser 10, here including a wall 11*a* of the upper face of the body itself, preferably but not necessarily a substantially plane wall, a receptacle 12 is defined designed to contain a washing agent, such as a solid washing agent in the form of powder or of tablet (even though not excluded are washing substances in some other form, such as liquid or gel).

The mouth of the receptacle 12 is preferably surrounded by a projecting edge or lip 12*a*, which here rises from the wall 11*a*. Constrained in the area A to the body 11 is a hatch or door, designated as a whole by 20 and comprising a door body 21, formed via moulding of thermoplastic material, which may be like the material constituting the dispenser body 11, for example, a polypropylene added with reinforcing material, such as talcum or glass fibre.

Figure 18:
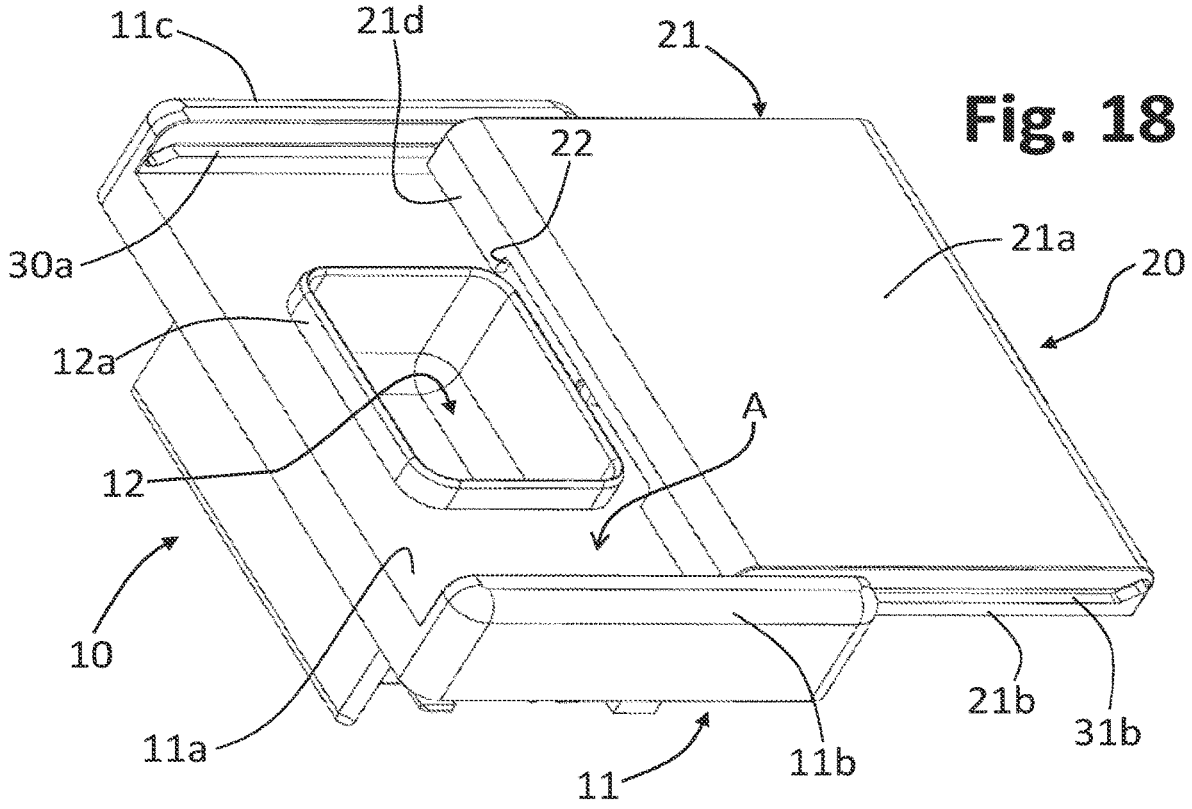

The door 20 is movable or slidable in a guided way on the body 11 so as to be displaceable between a position of closing and a position of opening of the receptacle 12, as illustrated in FIGS. 7 and 18, respectively. For this purpose, the door body 21 is constrained with respect to the dispenser body 11 via suitable slide guides.

In the example of embodiment illustrated, the dispenser 10 is devised for dispensing just the washing agent contained of the receptacle 12, but in other embodiments (not represented) the dispenser includes a further arrangement for dosage and/or dispensing of at least one further washing agent, for example, a liquid rinse aid. For instance, with reference to FIG. 9, the body of the dispenser may have lateral dimensions larger than what is represented and have, in a lateral area not covered by the door 20, the inlet of a reservoir of a second washing agent, such as a liquid agent, for example, a lustering agent, with a corresponding outlet opening forming part of a corresponding dispensing system.

In various embodiments, the door body 21 is urged towards the respective condition of opening of the receptacle 12 via elastic means, comprising, for example, a spring. A spring of this sort is, for instance, designated by 13 only in FIGS. 9 and 10, the ends of which are constrained between the body 11 and the body 21, possibly also via other interposed elements, for example, constrained via a coupling, or an engagement element, or a deformation of the thermoplastic material that forms the body.

Figure 10:
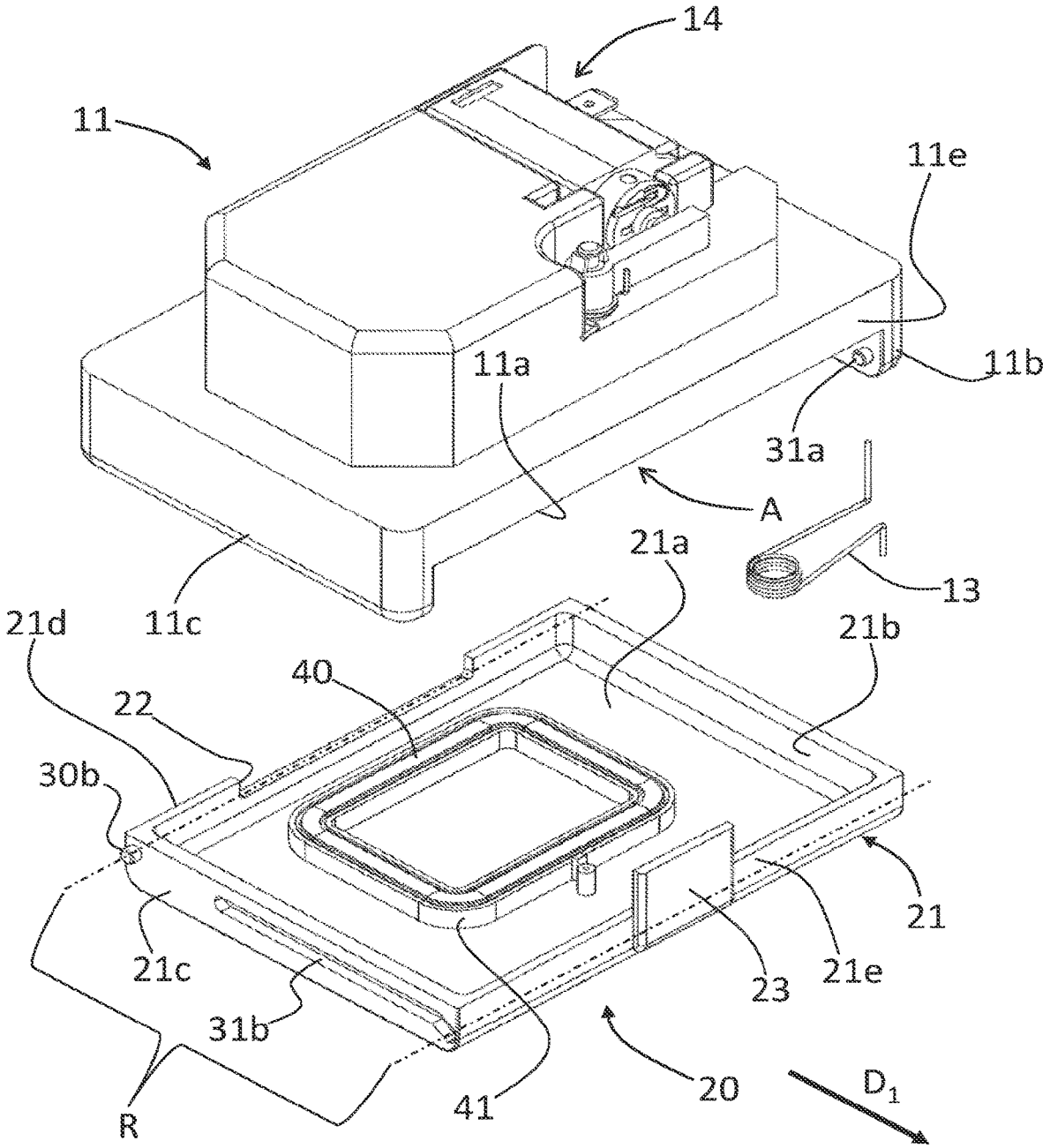

Operatively set between the body 11 and the body 21 is a system for blocking/release of the door 20, designated as a whole by 14 in FIGS. 8 and 10, which can be controlled by a timer of the machine or else manually. As may be seen in FIGS. 8-9, such a system 14 may include, for example, an engagement element 15 in the area A, fixed to the first end of a spindle 15*a* that passes through the body 11. Fixed to the second end of the spindle 15*a*, at the back of the body 11, is a lever 16, which is subject to the reaction of a corresponding spring 16*a*. The lever 16 can be displaced by an electric actuator 17, for example, a thermal or solenoid actuator, in such a way as to cause rotation of the spindle 15*a* and, hence, of the engagement element 15, which releases a corresponding engagement element (not represented) provided on an inner side of the door 20.

In various embodiments, for example, as may be seen in FIG. 9, the area A in which the receptacle 12 is defined and in which the door 20 moves is delimited laterally by portions of the body 11 that rise from a general plane, here substantially identified by the wall 11*a*. More in general, this area A is delimited laterally by two portions or walls that are generally opposite or set at a distance apart, designated by 11*b* and 11*c*, which are preferably substantially parallel to one another and to the direction of sliding of the door, indicated by the arrow D in FIG. 7.

The opposite portions 11*b* and 11*c* here defined as "walls" may comprise, for example, at least two portions of the body 11, which are in relief with respect to the plane of the area A or to the plane of the mouth part of the receptacle 12 and are located substantially in the proximity of the two opposite sides of the door 20. In the embodiment illustrated, the walls 11*b* is 11*c* are walls in relief, substantially at the lateral ends of the body 11. The walls 11*b* and 11*c* are preferably integrated in the body 11, even though they may be associated thereto in some other way, such as welding or gluing, or by engagement. In other embodiments, at least one of the walls 11*b* and 11*c*, or an additional wall, may be an intermediate wall in relief, for example, a wall of separation between the area A and the area in which the aforementioned mouth of a reservoir of a second liquid washing agent is located.

The door body 21 has a main wall 21*a*, the inner side of which generally faces the wall 11*a* of the body 11, as well as a series of side walls, which in the example extend from the wall 21*a* towards the wall 11*a*. More in general, the door body 21 has at least two sides or side walls, designated by 21*b* and 21*c*, which are preferably generally parallel to one another and to the direction D of sliding of the door 20, and hence preferably substantially parallel to the walls 11*b* and 11*c* of the body 11. These walls 21*b* and 21*c* are preferably integrated in the door body 21, even though they may be associated thereto in some other way, such as welding or gluing, or by engagement.

From FIG. 10 it may be noted how, mounted in a region of the lower face of the door body 21 (corresponding to the inner side of its wall 21*a*) that is comprised between the walls 21*b* and 21*c* is a annular gasket 40, preferably having a substantially quadrangular development or, more in general, a development similar to that of the projecting edge or lip 12*a* of the receptacle 12. The gasket 40 is preferably mounted in a respective housing or seat 41 defined on the inner side of the wall 21*a*.

Visible in different views in FIGS. 9-12 are the various portions of the body 11 and of the body 21 that are of specific interest for the purposes of possible embodiments of the invention, represented at least by the walls 11*b* and 11*c* of the dispenser body 11 and the walls 21*b* and 21*c* of the door body 21.

Clearly visible in FIG. 9 are the inner side of the wall 11*c* and the outer side of the wall 21*b*, whereas clearly visible in FIG. 10 are the outer side of the wall 21*c* and part of the inner side of the wall 11*b*.

Operative between the walls 11*b* and 21*b*, on one side, and the walls 11*c* and 21*c*, on the other side, are slide guides, which constrain the door body 21 with respect to the dispenser body 11. These slide guides comprise guide elements and guided elements, at the mutually facing sides of the walls 11*b* and 21*b* and the mutually facing sides of the walls 11*c* and 21*c*. In various embodiments, such as the one represented, the aforesaid facing sides are the inner sides of the walls 11*b* and 11*c* and the outer sides of the walls 21*b* and 21*c*, respectively, but this does not constitute an essential characteristic of the invention. In fact, according to alternative embodiments, the aforesaid facing sides could be the outer sides of the walls 11*b* and 11*c* and the inner sides of the walls 21*b*, 21*c*, respectively. On the other hand, according to further embodiments, one slide guide could be provided between the inner side of the wall 11*b* and the outer side of the wall 21*b*, whereas the opposite slide guide could be provided between the outer side of the wall 11*c* and the inner side of the wall 21*c* (or vice versa).

It should be noted that the walls of the dispenser body in which the slide guides for the door are in part provided are not necessarily walls generally opposite and/or parallel to one another. For instance, in accordance with possible variant embodiments, these guide walls could lie substantially in one and the same plane (consider a substantially flat door, with the respective guide parts defined on the inner or lower side of the door), or else be arranged angled with respect to one another (for example, with one guide wall substantially vertical and the other guide wall substantially horizontal). It is consequently evident that, according to these variants, also the corresponding walls of the door body in which the respective parts of the slide guides are defined do not necessarily have to be opposite and/or parallel to one another.

According to one embodiment of the invention, for at least one wall 11*b* and 11*c* of the dispenser body 11, in particular for each wall 11*b* and 11*c*, the guide elements comprise at least one seat 30*a* and at least one projecting element 31*a*, both defined in the side of the respective first wall 11*b* or 11*c* that faces the corresponding side of the corresponding second wall 21*b* or 21*c* of the door body 21.

On the other side, for at least one wall 21*b* and 21*c* of the door body 21, in particular for each wall 21*b* and 21*c*, the guided elements comprise at least one second projecting element 30*b* and one second seat 31*b*, both defined in the side of the respective wall 21*b* or 21*c* that faces the corresponding side of the corresponding wall 11*b* or 11*c* of the dispenser body 11. Each projecting element 31*a* of the first walls 11*b*, 11*c* is engaged in a respective seat 31*b* of the second walls 21*b*, 21*c*, whereas each projecting element 30*b* of the second walls 21*b*, 21*c* is engaged in a respective seat 30*a* of the first walls 11*c*, 11*c*. In preferred embodiments, the seats 30*a* and 31*b* extend longitudinally, in particular in the form of grooves or similar recessed elements, but not excluded from the scope of the invention is the case of seats defined by parts in relief with respect to the side of interest of the corresponding wall of the body 11 or of the body 21, for example, in the form of rails. In preferred embodiments, the projecting elements 30*b* and 31*a* comprise sliding elements in relief, for example, in the form of pins or studs.

Thanks to the above characteristic, the length of the seats 30*a* and 31*b*, for example in the form of guide grooves 30*a* and 31*b*, may be increased as compared to the prior art, as likewise the distance between the projecting elements 30*b* and 31*a*, on each side of the door 20. The fact that one projecting element 30*b* is provided on the door 20 and the other projecting element 31*a* on the dispenser body 11 enables exploitation of the entire length of the seats 30*a* and 31*b*, respectively on the body 11 and the door 20, likewise increasing the travel of the latter.

In various embodiments, the projecting elements 30*b*, 31*a* are configured substantially as studs or pins projecting from the corresponding wall, preferably cylindrical pins or, more in general, pins designed to enable prevalently sliding, albeit also allowing possible angular movements.

In what follows, for simplicity, the elements 30*b*, 31*a* will also be defined as "pins", and specifically also as "guide pins" with reference to the pins 31*a*, and "guided pins" with reference to the pins 30*b*. In line with this, the seats 30*a*, here represented by way of example in the form of grooves, will also be defined as "guide grooves" and the elements 31*b* as "guided grooves", where the term "groove" is not, however, intended to limit the invention to the case of recessed seats, as already mentioned above.

By the terms "guide pins" and "guide grooves" are meant elements that are located in a fixed position or are fixed with respect to the body 11 of the dispenser 10, whereas by the terms "guided pins" and "guided grooves" are meant elements located in a position movable with respect to the body 11 of the dispenser 10 and/or elements that are located in a fixed position or are fixed with respect to the body 21 of the door 20.

In the example illustrated, the grooves 30*a*, 31*b* and the pins 30*b* and 31*a* are defined integrally by the bodies 11 and 20 following upon moulding of these bodies with thermoplastic material. The grooves 30*a* and the pins 31*a* are defined on the corresponding walls 11*b* and 11*c*, whereas the grooves 31*b* and the pins 30*b* are defined on the corresponding walls 21*b* and 21*c*. As may be appreciated, and as may be clearly seen, for example, in FIGS. 11 and 12, each guide pin 31*a* of the dispenser body 11 is engaged in a corresponding guided groove 31*b* of the door body 21, whereas each guided pin 30*b* of the door body 21 is engaged in a corresponding guide groove 30*a* of the dispenser body 11.

Figure 20:
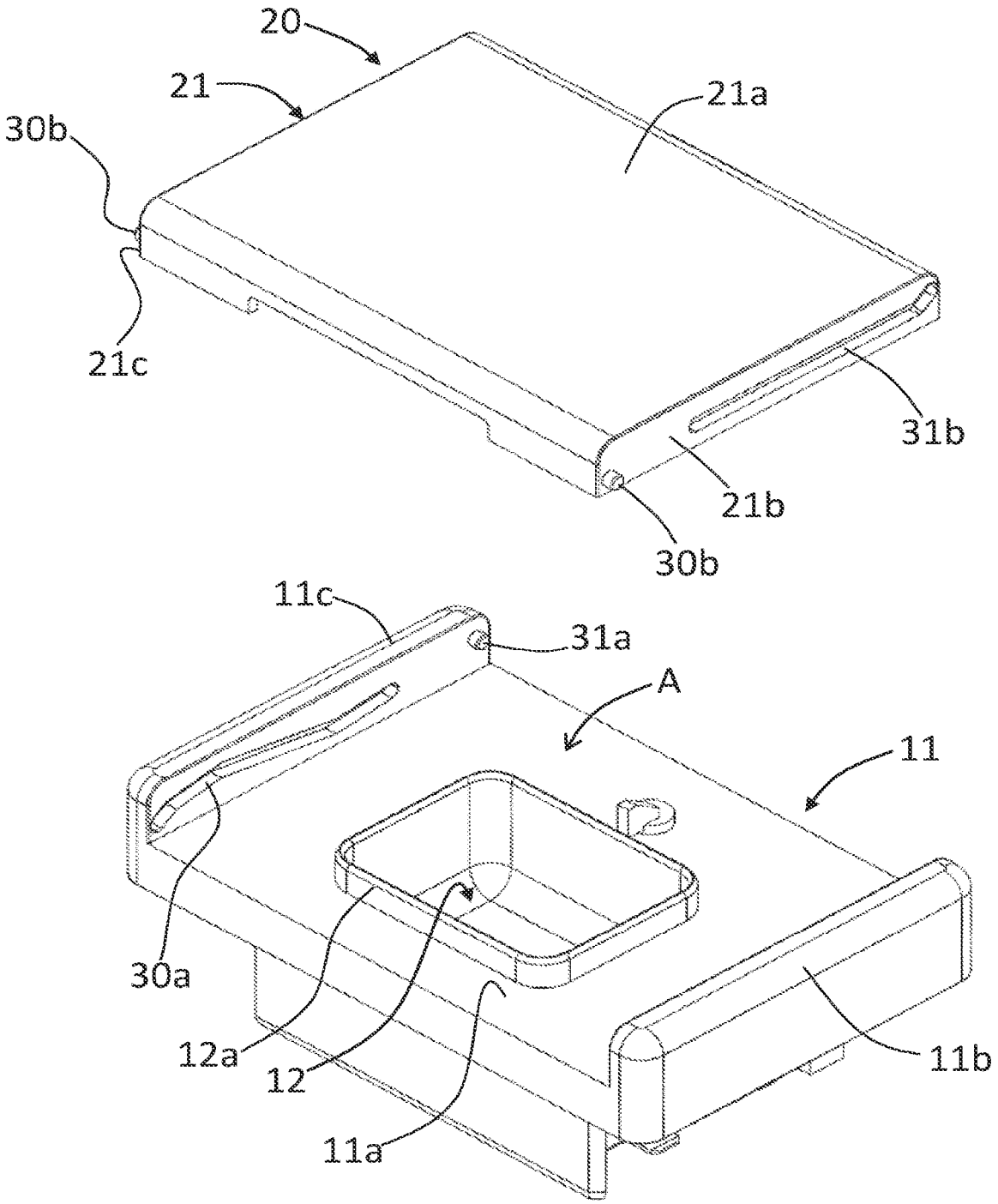
Figure 21:
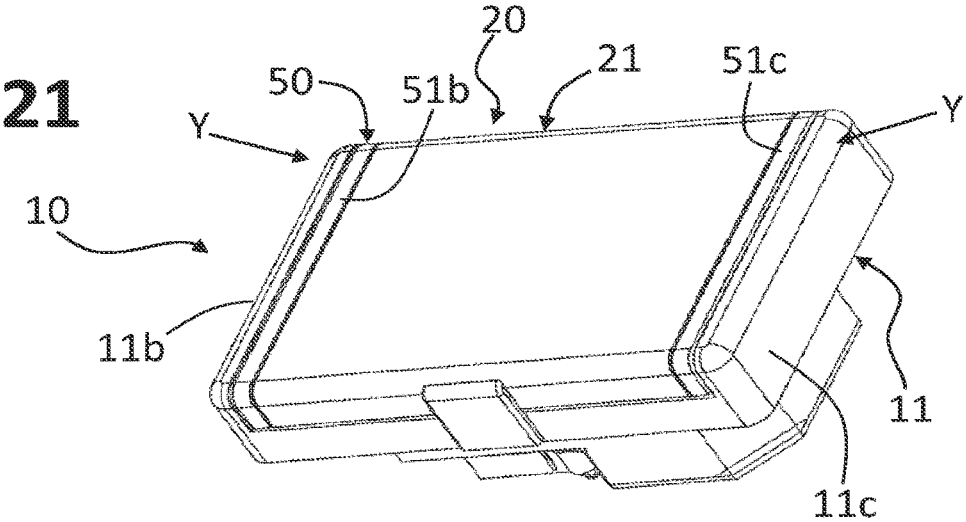
FIGS. 21-24 are schematic illustrations of a further possible embodiment of a dispenser of washing agents according to the invention.

In various embodiments, the grooves 30*a* and 31*b* have the same development in length, but this does not constitute an essential characteristic (see, for example, the case of the embodiment of FIG. 20).

Irrespective of their specific shapes, each of the guide grooves 30*a* of the dispenser body 11 and each of the guided grooves 31*b* of the door body 21 have an initial end region and a final end region, which can be engaged by the corresponding pins 30*b* and 31*a* when the door 20 is in the position of closing (as, for example, in FIGS. 11-12) and position of opening (as, for example, in FIGS. 16-18), respectively. With reference to the direction of displacement of the door 20 from the closed position to the open position, indicated by the arrow $D_1$ in FIGS. 9 and 10, the guide pins 31*a* are each set at a distance from the distal end of the corresponding guide groove 30*a*, whereas the proximal ends of the guided grooves 31*b* are each set at a distance from the corresponding guided pin 30*b*.

The slide guides, and more in particular the grooves 30*a* and 31*b*, are preferably configured in such a way that the gasket 40 comes into contact with the sealing lip 12*a* of the receptacle 12 only in a final stage of the displacement of the door 20 from the open position to the closed position, which is usually performed manually by a user after loading of a washing agent into the receptacle itself.

Figure 13:
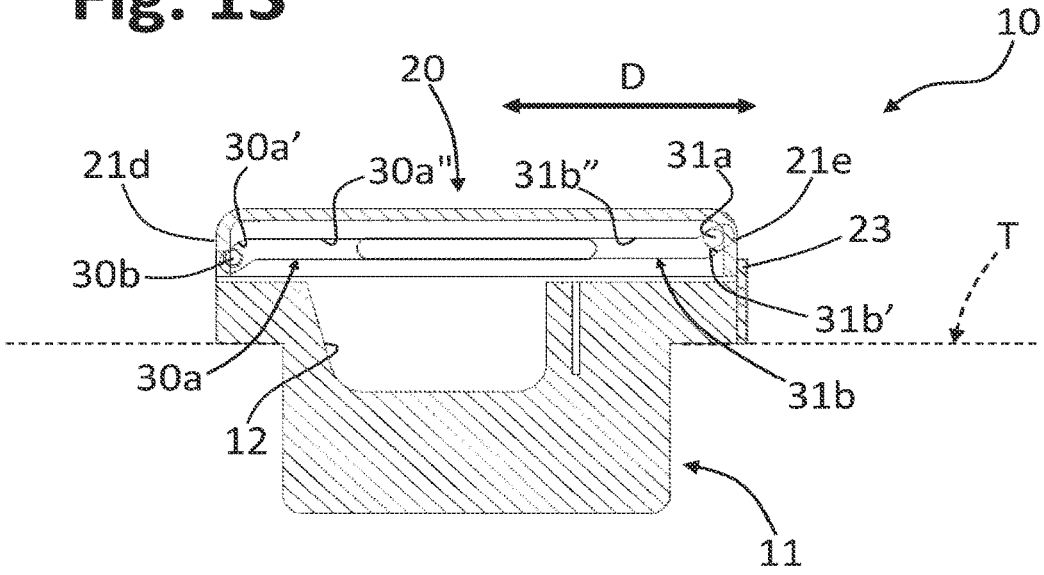
FIGS. 13 and 14 are partial and schematic cross sections of a dispenser of washing agents according to an embodiment of the invention, in the positions of closing and opening of a corresponding door, respectively.
Figure 14:
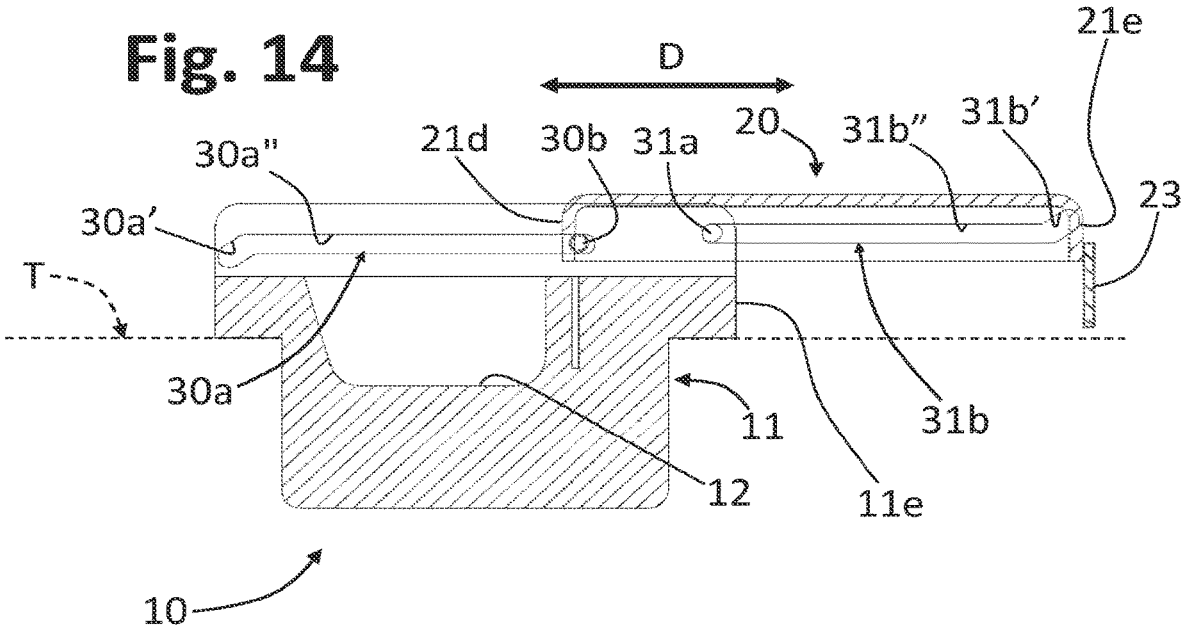

For this purpose, preferably, in various embodiments a proximal end region of each guide groove 30*a* has a groove portion, which extends at a level lower than that of the guide pin 31*a* (taking as reference a plane or wall of the door or of the dispenser, such as the main wall 21*a* or the area A, and/or a horizontal position of the dispenser, as, for example, in FIGS. 13-14). For the same reason, in the distal end region of each guided groove 31*b* has a groove portion that extends at a level higher than the guided pin 30*b* (once again with reference to a plane or wall of the door or of the dispenser, such as the main wall 21*a* or the area A, and/or a horizontal position of the dispenser, as in FIGS. 13-14): this feature may in particular be appreciated from FIGS. 13 and 14, where the aforesaid proximal and distal end portions are designated by 30*a*' and 31*b*', respectively.

In the example represented, the groove portions 30*a*' and 31*b*', the proximal one and the distal one respectively, hence extend at a level different from the level at which a remaining main portion 30*a*" and 31*b*" of the respective groove 30*a* or 31*a* extends, here a substantially linear or rectilinear main portion. Once again with reference to the case illustrated, then, the portion 30*a*' of each guide groove 30*a* is an initial portion, which extends at a height or level lower than that of the remaining main portion 30*a*". The groove portions 30*a*' are preferably inclined downwards so that each constitutes a sort of step that is engaged by the corresponding guided pin 30*b* during the final phase of sliding of the door 20 towards the closed position. On the other side, the portion 31*b*' of each guided groove 31*b* is a final portion, which extends at a height or level higher than that of the remaining main portion 31*b*". The groove portions 31*b*' are preferably inclined upwards, to constitute each a sort of step that is engaged by the corresponding guide pin 31*a* during the final phase of sliding of the door 20 towards the closed position.

It will be appreciated that with this arrangement, in the aforesaid final phase of sliding of the door 20 into the closed position, a displacement downwards of the door itself is brought about so that, in its engagement condition, the sealing surface of the gasket 40 is pressed against the sealing edge 12*a* of the receptacle 12. It will likewise be appreciated that, in the course of displacement of the door 20 between the closed and open positions there is a variation of the relative position in height of the guided grooves 31*b* with respect to the guide grooves 30*a*. The characteristic in question may, for example, be appreciated from a comparison between FIGS. 13 and 14: as may be noted, in the case exemplified, in the condition of closing of the door 20 the grooves 30*a* and 31*b* are located substantially at the same height. Instead, following upon opening of the door 20, the grooves 31*b* come to be located in a position at least slightly higher than the grooves 30*a*, here on account of the presence of the inclined portions 30*a*' and 31*b*' of the grooves themselves.

Irrespective of the specific shape of the grooves 30*a*, 31*b*, in various embodiments, in the closed position of the door 20, a portion of the guide grooves 30*a* substantially faces a portion of the guided grooves 31*b*. Also such a characteristic may be appreciated from FIG. 13, in which there may be noted a partial overlapping of the grooves 30*a* and 31*b*. The figure in question represents the case of prevalently rectilinear grooves 30*a* and 31*b* with an (initial or final) inclined end portion, but the grooves may have at least in part facing portions even it they have a different shape, as, for example, in the embodiments of FIGS. 19 and 20 described hereinafter.

From the figures, and in particular from FIGS. 9 and 10, it may be noted how, in a preferred embodiment, the proximal or initial ends of the guide grooves 30*a* are each located in an end region of the corresponding side (here the inner side) of the wall 11*c* or 11*b*, whereas the guide pins 31*a* are each located in the opposite end region of the same side of the wall 11*b* or 11*c*. Likewise, the guided pins 30*b* are each located in an end region of the corresponding side (here the outer side) of the respective wall 21*b* or 21*c*, whereas the final or distal ends of the guided grooves 31*b* are each located in the opposite end region of the same side of the wall 21*b* or 21*c*. This feature, as will be seen hereinafter, contributes to guaranteeing a homogeneous and distributed thrust of the gasket 40 with respect to the mouth of the receptacle 12 represented by its projecting lip 12*a*.

In various embodiments, the gasket 40 is mounted in a region of the lower face of the wall 21*a* of the body 21, which—with reference to the longitudinal direction of the walls 21*b* and 21*c*—is located in an intermediate position between the guided pins 30*b* and the final ends of the guided grooves 31*b*. This feature may be inferred, for example, from FIG. 10, where designated as a whole by R is the region of the door that is comprised between the two parallel axes represented dashed, which pass between the pins 30*b* and between the final ends of the grooves 31*b*, respectively. Also this characteristic contributes to guaranteeing a homogeneous and distributed thrust of the gasket 40 with respect to the projecting lip 12*a* of the receptacle 12. This inventive characteristic is present also in the case of other possible sealing configurations, such as the case not represented of a second gasket instead of the lip 12*a*, or else of a gasket 40 mounted on the body 11 and a lip 12*a* fixed with respect to the door 20.

Figure 15:
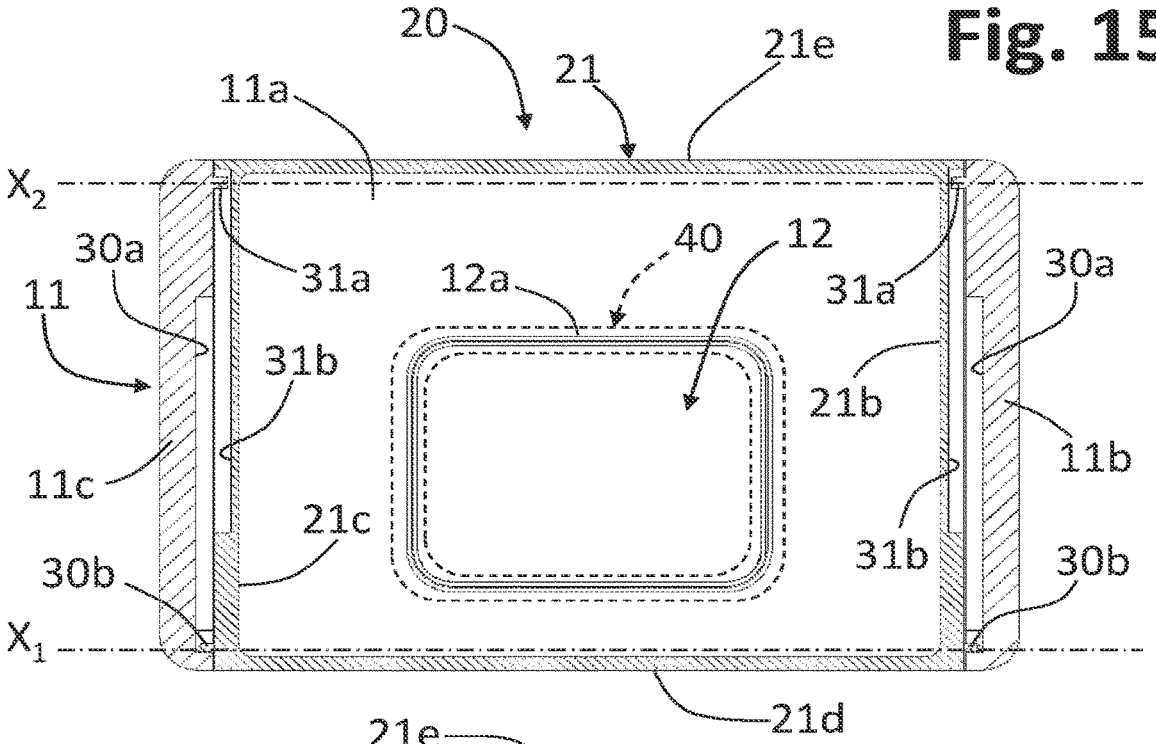
FIGS. 15 and 16 are partial and schematic longitudinal sections of a dispenser of washing agents according to an embodiment of the invention, in the positions of closing and opening of a corresponding door, respectively.

The advantages of the invention linked to the positioning of pins and grooves, as well as to the positioning of the gasket, may be inferred from FIG. 15. Highlighted in this figure are the axes $X_1$ and $X_2$, passing through the guide pins 30*b* and the guided pins 31*a*, respectively. Of course, the same axes may also be considered indicating the positions of the initial ends of the guide grooves 30*a* (axis $X_1$) and of the final ends of the guided grooves 31*b* (axis $X_2$). From FIG. 15 it may be immediately noted how the gasket 40 is located entirely in a region of the door body 21 that is comprised between the axes $X_1$ and $X_2$.

The action of thrust of the gasket 40 on the lip 12*a* is determined by the pins 30*b* and 31*a*, which constrain the door body 21 to the dispenser body 11. It will be appreciated from FIG. 15 that, in the closed position of the door 20, the pins 30*b* and 31*a* exert their action of thrust substantially in the four corner areas of the door body 21, which in turn exerts a distributed and homogeneous thrust of the gasket 40 on the lip 12.

Figure 1:
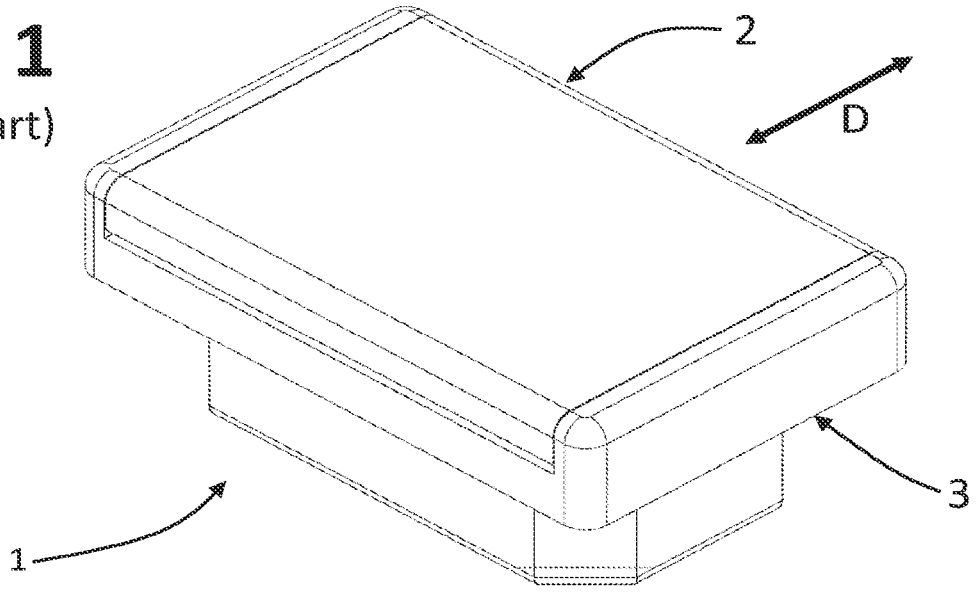
Fig. 1 (prior art)
FIG. 1 is a schematic perspective view of a dispenser of washing agents of a known type.
Figure 2:
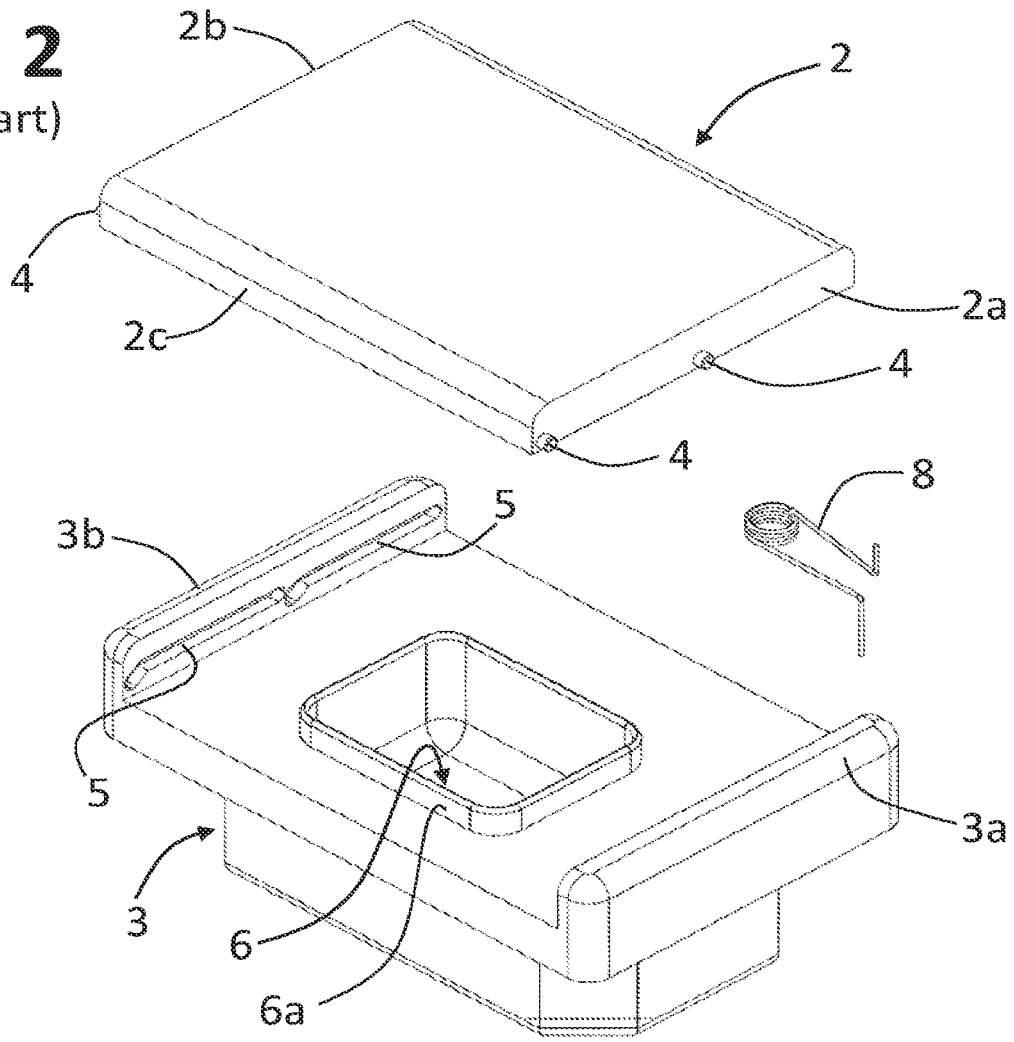
Fig. 2 (prior art)
FIG. 2 is a partially exploded view of the dispenser of FIG. 1.
Figure 3:
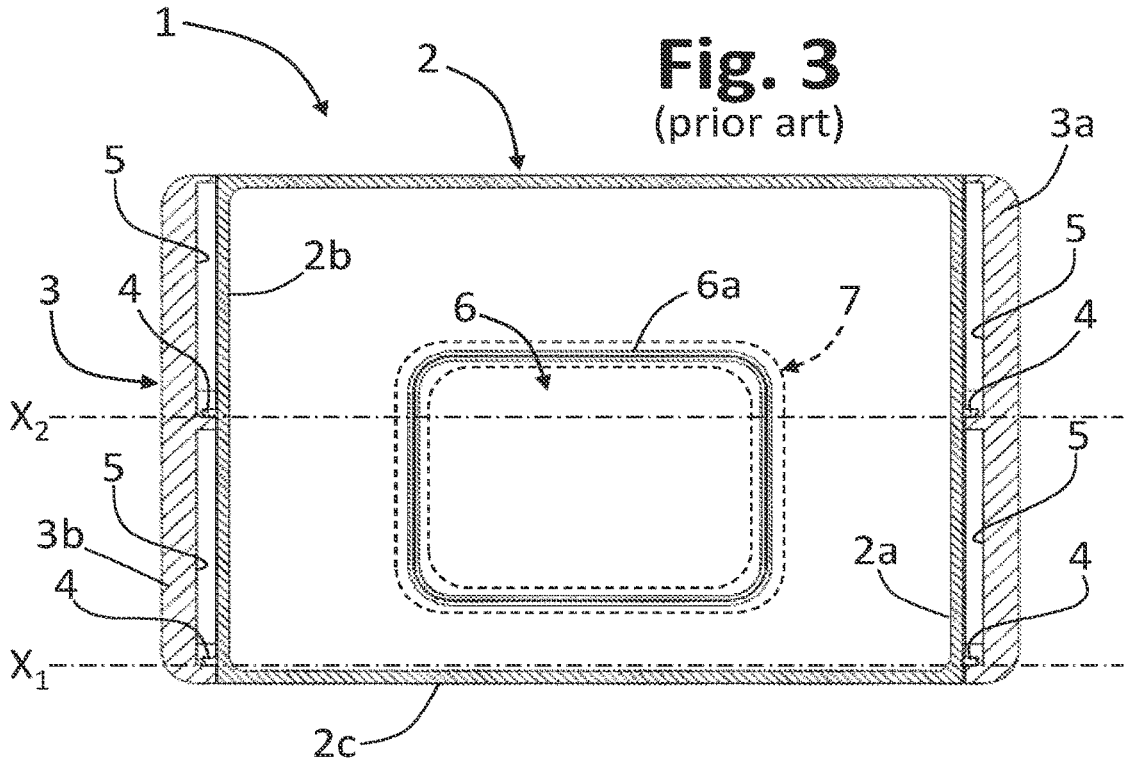
Fig. 3 (prior art)
FIGS. 3 and 4 are partial and schematic longitudinal sections of the dispenser of FIG. 1, in the positions of closing and opening of a corresponding door, respectively.

The resulting advantages emerge clearly from a comparison between FIGS. 3 and 15.

As has been said, FIG. 13 illustrates a condition where the door 20 is closed, with the pins 30*b* and 31*a* that engage the initial and final end regions, respectively, of the grooves 30*a* and 31*b*. When the door 20 is released by the corresponding blocking/release system 14 (FIGS. 8, 10)—upon command of the timer of the dishwasher or manually by the user—the door itself is urged by the corresponding spring 13 (FIGS. 9, 10) towards the open position, with sliding of the guided elements, represented by the pins 30*b* and the grooves 31*b*, along the corresponding guide elements, represented by the grooves 30*a* and the pins 31*a*. With reference also to FIG. 14, in the course of this movement the guided pins 30*b* follow the initial inclined portion 30*a*' of the respective guide grooves 30*a*, and the final inclined portion 31*b*' of the guided grooves 31*b* slides on the respective guide pins 31*a*, thereby causing a slight raising or moving-away of the door 20 from the body 11. The door 20 then proceeds in its opening movement, with the guided pins 30*b* that follow the main portion 30*a*" of the respective guide grooves 30*a*, and with the main portion 31*b*" of the guided grooves 31*b* that slides on the respective guide pins 31*a* as far as the end-of-travel position, determined, for example, by the spring 13 or by the mechanical interference between the pins and the final end of the corresponding grooves (or by a possible other end-of-travel damping element, for example, of an elastic or elastomeric type, associated to the door 20 and/or to the dispenser body 11).

With the dispenser 10 according to the invention it is possible to obtain a travel of opening of the door 20 decidedly greater as compared to the prior art exemplified in FIGS. 1-6. This feature may be clearly inferred, for example, from a comparison between FIGS. 4 and 16, the latter representing the end-of-travel position of opening of the door 20, i.e., a situation similar to the one represented in FIG. 14. As may be noted in FIG. 16, the guided pins 30*b* of the door body 21 engage the final end regions of the guide grooves 30*a* of the dispenser body 11, whereas the initial end regions of the guided grooves 31*b* of the door body 21 are engaged by the guide pins 31*a* of the dispenser body 11.

The fact that one guide groove 30*a* and one guide pin 31*a* are defined on each wall 11*b* and 11*c* of the body 11 and, conversely, one guided pin 30*b* and one guided groove 31*b* are defined on each wall 21*b* and 21*c* of the body 21 enables, in the open position of the door 20, the guided pins 30*b* to be very close to the guide pins 31*a*, thereby affording a greater travel of the door. This inventive solution, in particular with pins that are movable and can be brought closer to one another, also enables a smaller distance to be obtained between the pins as compared to known solutions, where the pins are at a predefined fixed distance from one another.

The extent of this travel may of course be determined in the design stage and is a function of the length of the grooves 30*a*, 31*b* and of the distance of the pins 31*a* and 30*b* from the final end and the initial end, respectively, of the grooves 30*a* and 31*a*. As has been said, the fact that for each side of the door one guide groove is located on the body 11 and one guided groove is located on the body 21 enables increase of the length between the grooves themselves, and hence a greater distance between the corresponding pins 30*b* and 31*a*, with a consequently high stability of movement of the door, even though the travel allowed is increased as compared to the prior art.

Figure 4:
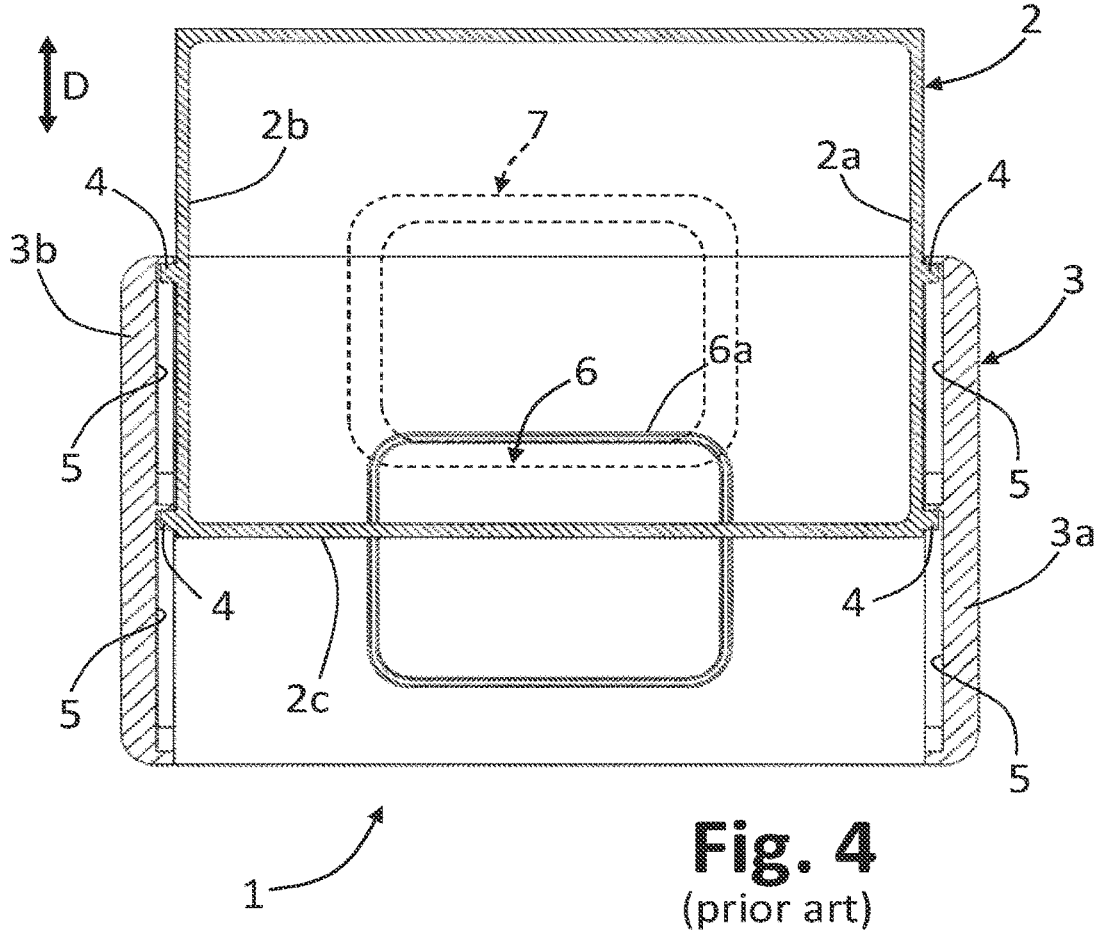
Fig. 4 (prior art)
Figure 5:
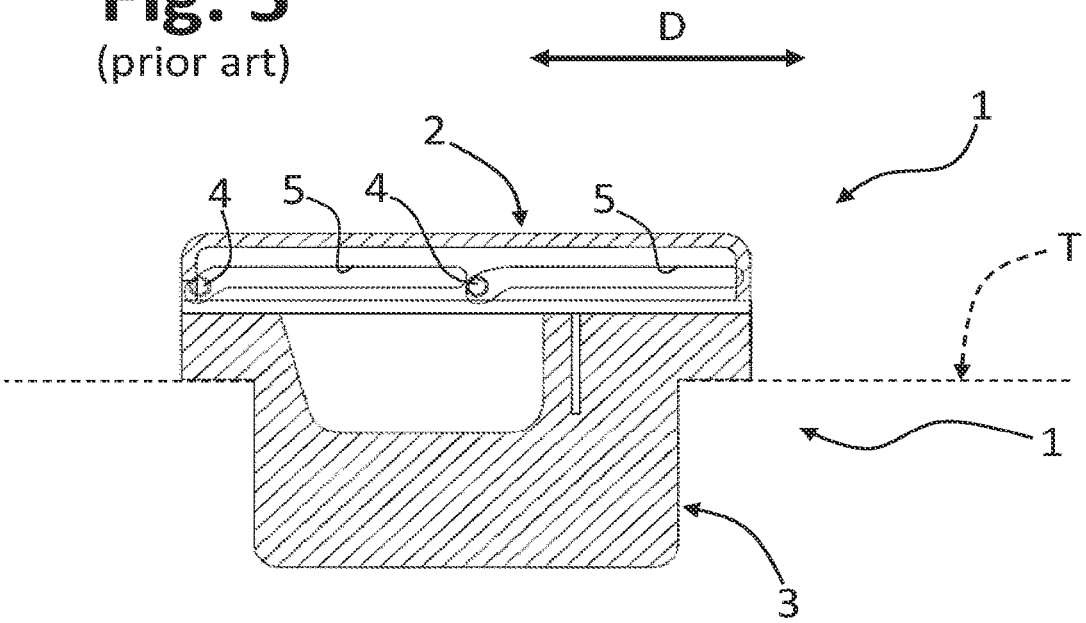
Fig. 5 (prior art)
FIGS. 5 and 6 are partial and schematic cross sections of the dispenser of FIG. 1, in the positions of closing and opening of a corresponding door, respectively.
Figure 6:
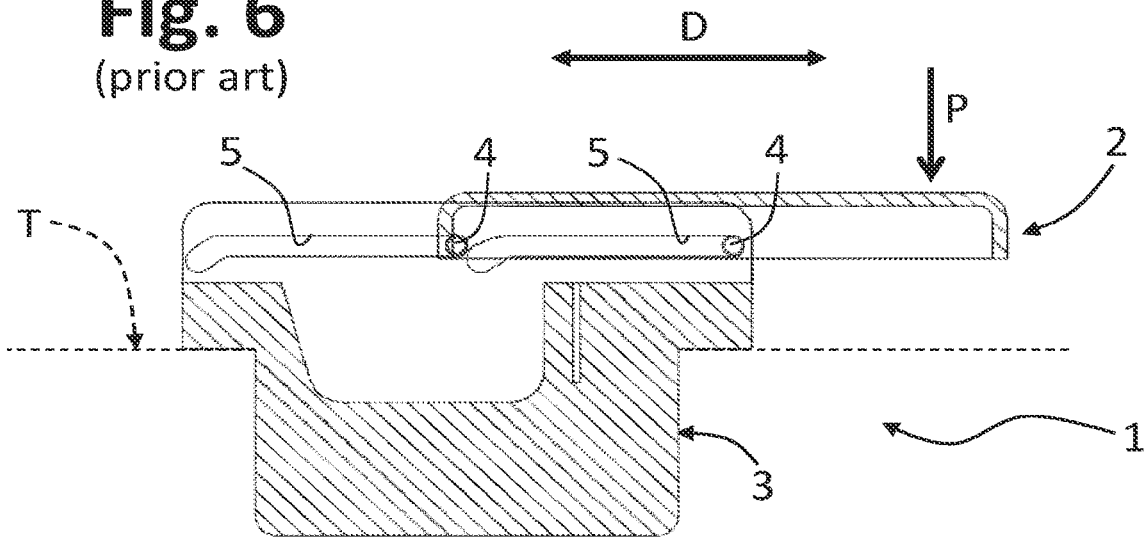
Fig. 6 (prior art)
Figure 16:
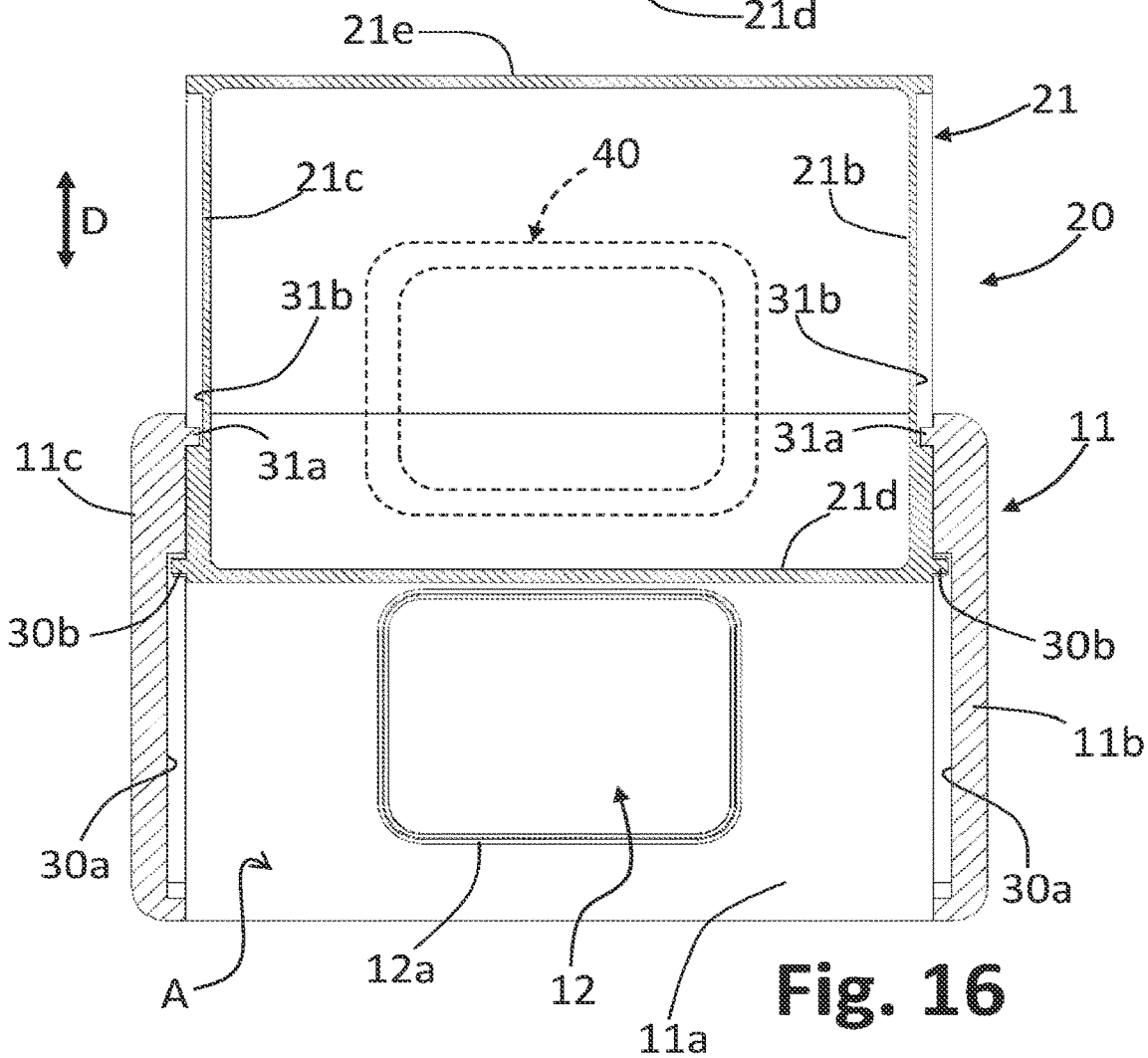
Figure 17:
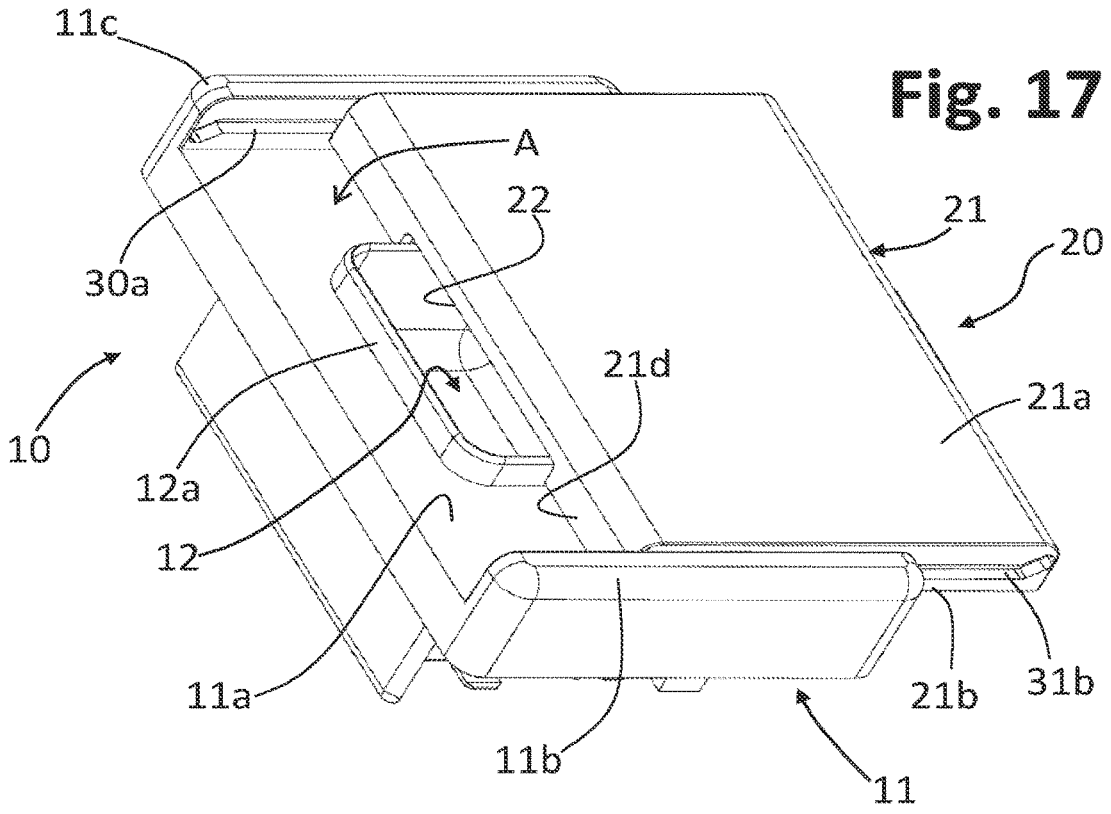
FIGS. 17 and 18 are schematic perspective views of a dispenser of washing agents according to an embodiment of the invention, with a corresponding door in two different positions during opening.

As may be noted in FIG. 16 (substantially given the same dimensions of the dispenser body, of the door body, of the receptacle, and of positioning of the latter as compared to the known dispenser of FIG. 4) in the dispenser according to the invention the greater travel of opening allowed for the door 20 enables the receptacle 12 to be completely exposed, with a facilitated dispensing and/or removal of the washing agent contained therein, whether it is in the form of powder, tablet, liquid, gel, or foam, moreover enabling a better washing and cleaning of the receptacle by the jets of washing water.

It will be appreciated that, in a dispenser according to the invention, the mutual position between the projecting elements, for example, in the form of pins, and the mutual position of the seats, for example, in the form of grooves, varies during movement of the sliding door.

In an advantageous embodiment, the door body 21 has an end portion or wall, the lower profile of which defines a recess, so that the aforesaid wall does not interfere with the sealing lip 12*a* of the receptacle 12 during the displacements of the door 20. This portion or wall may be defined as "rear", as viewed from the direction of displacement ($D_1$, FIGS. 9 and 10) of the door 20 from the closed position to the open position. This feature enables reduction of the extent of the displacements upwards and downwards of the door 20, in the course of its passage between the open and closed positions, i.e., reduction of the length of the initial and final inclined portions of the grooves 30*a* and 31*b*, respectively, and then, in the final analysis, reduction of the height both of the side walls 11*b*, 11*c* of the body 11 and of the side walls 21*b* and 21*c* of the body 21, to the advantage of compactness of the dispenser 10.

The rear transverse wall of the body 21 is designated by 21*d* in the figures and is in particular the transverse wall closer to the guided pins 30*a*, which extends substantially between the side walls 21*b* and 21*c* and is substantially orthogonal to the wall 21*a*, associated to which is the gasket 40. In the figures, the aforesaid recess is instead designated by 22 and is substantially in a central position of the lower profile of the wall 21*d* or, in any case, in a position aligned to the lip 12*a* of the receptacle 12. The recess 22 could also extend substantially throughout the width of the wall 21*d*.

The dimensions in height and width of the recess 22 are such that, in the movement of the door 20, its transverse wall 21*d* will not interfere with the lip 12. The concept may be clearly inferred from FIGS. 17 and 18, where the door 20 is represented in an intermediate position and in the final position of its opening movement.

According to a characteristic that is in itself autonomously inventive, the door body 21 defines, or has associated, at least one supporting element that projects downwards, i.e., towards the wall of the machine on which the dispenser 10 is fixed and has a lateral surface facing a corresponding end wall or portion of the dispenser body. Preferably, the aforesaid supporting element is associated or defined at an end portion or wall of the door body, it, however, being possible for it to be associated at least in part to the dispenser body 11 or defined by the latter. The aforesaid portions or walls of the door body and of the dispenser body may be defined as "front", as viewed from the direction of displacement ($D_1$, FIGS. 9 and 10) of the door 20 from the closed position to the open position. As will emerge clearly, the aforesaid supporting element has the function of preventing any risk of damage to the door 20 or to its guide system, when the door is in the open position and a portion thereof projects substantially in cantilever fashion from the dispenser body (a condition in which the door could be occasionally urged in an anomalous way, for example, by a user or by a pan resting on the open door).

The aforementioned front transverse wall of the body 21 is designated in the figures by 21*e*, whereas designated by 11*e* is the corresponding wall of the body 11. The transverse wall 21*e* is in particular the one closer to the final end of the guided grooves 31*b*, which extends substantially between the side walls 21*b* and 21*c* and is substantially orthogonal to the wall 21*a*, associated to which is the gasket 40. In the figures, the aforesaid supporting element is instead designated by 23 and has a length greater than the distance between the inner side 21*a* of the body 11 and the wall 11*a* of the body 11. In the example illustrated, the supporting element 23 projects towards from the door, i.e., towards the wall on which the dispenser 10 is fixed, at the outer side of the wall 21*e*. In this way, the element 23 does not hinder movement of the door towards the closed position, it being possible for it to come into contact with the wall 11*e* of the body 11. In the case of a door body 21 that has a greater extension in a longitudinal direction, i.e., with a part of its wall 21*a* that projects from the dispenser body 11 even when the door 20 is closed, the at least one supporting element 23 may be provided at the inner side of the aforesaid projecting part of the wall 21*a*.

Preferably, the element 23 has a substantially flattened shape, here substantially in the form of a plate so as not to increase considerably the overall dimensions of the dispenser. Once again with reference to the example illustrated, the supporting element 23 is located in a central position of the wall 21*e*, but this position is not to be understood as limiting in so far as, in variant embodiments, there could be provided an element 23 with a width at least equal to that of the door 20 or else two or more elements 23 distributed along the wall 21*e*. The supporting element could then comprise a number of elements in relief, which may be located in other positions, such as the two ends of the door 20, in positions corresponding to the two walls 21*b* and 21*c*, and may be provided with an elastic element for resting on the wall of the washing machine, such as a element made of elastomeric material.

The element or elements 23 are preferably formed integrally with the door body 21, in the course of moulding of the latter, but not excluded from the invention is the case of at least one supporting element 23 configured as distinct component and applied to the door body 21.

The function of the supporting element 23 may be readily inferred from FIG. 14, where the door 20 is open and a portion thereof projects in cantilever fashion from the dispenser body 11. As may be appreciated, in such a condition, the presence of the element 23 makes it possible to counter the amount of bending or stresses that can be exerted from above on the aforesaid projecting portion of the door 20, due, for example, to accidental impact by the user or by relatively heavy objects that drop on the door itself. In these unfavourable circumstances, in fact, the presence of the element 23 counters, for example, bending of the projecting part of the door, and hence the consequent stress on its guide system. For this reason, it is preferable for the height of the element 23 to be as great as possible, compatibly with the space available in height. In the case exemplified in FIG. 13, for instance, the portion of the supporting element 23 that extends downwards beyond the lower edge of the wall 21*e* has a length (height) slightly smaller than the height of the wall designated by 11*e* of the dispenser body 11, the lower edge of which is substantially in contact with the surface of the door T.

In this way, the lower edge of the supporting element does not interfere with the side of the door T in which the body 11 is partially set in. Moreover, following upon opening of the door 20, and hence its slight raising due to the inclined portions of the grooves 30*a* and 31*b*, the distance between the lower edge of the element 23 and the corresponding side of the door T remains in any case minimal: consequently, in the case of impact on the projecting portion of the door, its bending will be very limited, with a practically absent or minimal stress on its guide system.

From the foregoing description, the characteristics of the present invention emerge clearly, as likewise its advantages.

It is clear that numerous variations may be made to the dispenser described by way of example by the person skilled in the art, without thereby departing from the scope of the invention as defined in the ensuing claims.

Figure 19:
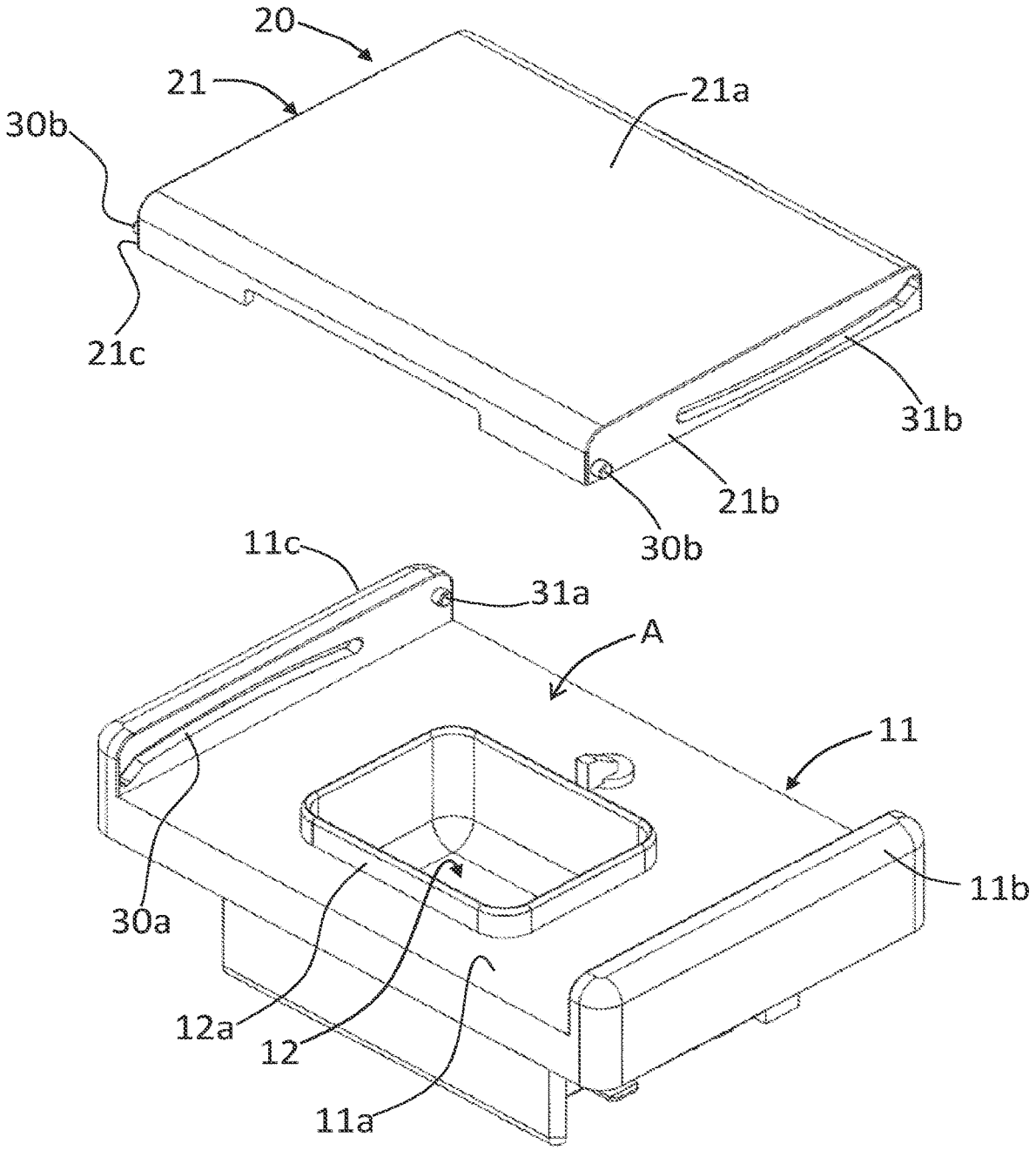
FIGS. 19 and 20 are partial and schematic partially exploded views of a dispenser of washing agents in accordance with further embodiments of the invention.

FIGS. 19 and 20 illustrate possible variant embodiments of the invention, specifically in relation to the shape of the guide grooves and/or of the guided grooves, which may of course be modified according to the type of sliding desired for the door, for example, at least in part arched.

In particular, FIG. 19 illustrates the case where the guide grooves 30*a* and the guided grooves 31*b* both have a prevalent portion substantially curved or arched so as to obtain a corresponding movement of the door 20 in the course of its displacements between the open and closed positions. Also in the embodiment exemplified, the grooves have the initial or final end portions inclined, even though this may not be indispensable in the case of curved grooves.

The shape of the guide grooves is not necessarily similar to the shape of the guided grooves. Also the development in length of the grooves on the body 11 and on the body 21 is not necessarily the same. These cases are both represented in FIG. 20, where the guided grooves 31*b* on the body 21 are similar to the ones illustrated with reference to FIGS. 7-18, whereas the guide grooves 30*a* on the body 11 have a different shape, which is hence distinguished by a succession of portions or stretches inclined at different angles (which could also be replaced by a number of curved stretches, or by stretches curved in different directions, which may be associated to linear stretches, such as for example a guide with a substantially S-shaped path).

In the specific case illustrated, moreover, it will be appreciated that the development in length of the grooves 30*a* is greater than that of the grooves 31*b*, even though operation of the door, as regards its displacements, is substantially similar to the one already described above.

The invention has been described with reference to examples of embodiment in which the guide parts of the door 20 are present on a stationary body of the dispenser 10 (the body 11) and the corresponding guided parts are present on a movable body (the body 21). In possible variant embodiments not represented, at least part of the guides may be defined in one or more mechanical connection members or elements, set between a stationary body of the dispenser and a movable body of the door, such as for example stationary elements or members fixed to the dispenser body 11 and/or to the door body 21, or else movable transmission elements or members, which are also articulated to the aforesaid stationary body and/or to the movable body, such as for example a crank element.

In this perspective, it is moreover pointed out then that the terms "dispenser body" and/or "door body" present in various parts of this description and of the ensuing claims are intended to include also fixed or movable elements associated to the bodies previously designated by 11 and 21, such as the aforementioned interposed members or elements, which connect a stationary part of the dispenser and its door, for example, for constraining or guiding the movement of the door itself with respect to the aforesaid stationary part, it being possible for said interposed elements or members to be associated to the at least one body or both of the bodies 11 and 12. The aforesaid interposed elements or members may hence comprise guide elements and guided elements similar to the ones described previously.

An example of embodiment of dispenser provided with a movable interposed element or member is illustrated in FIGS. 21-24. In this case, the dispenser body 21 comprises a transmission element, designated as a whole by 50, hinged to the body 21, and slidably coupled to which is the door body 21.

Figure 22:
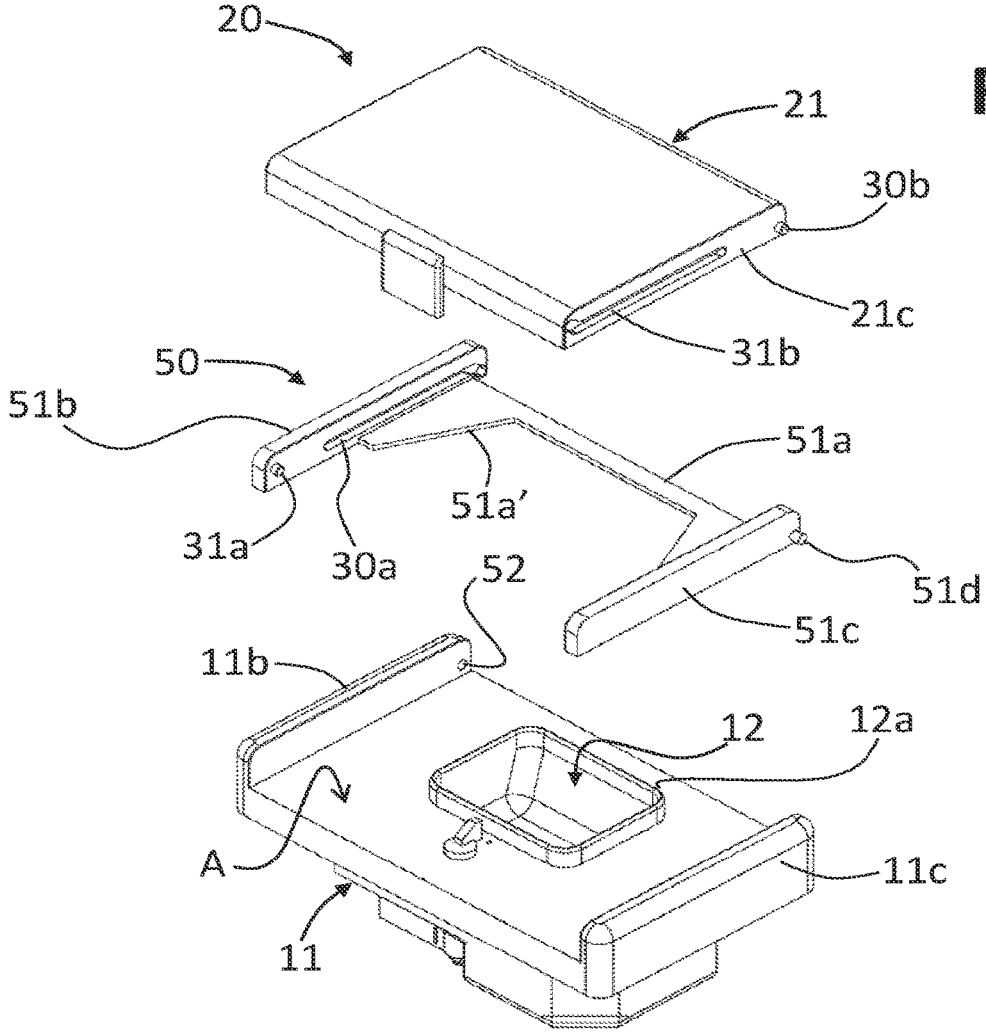
Figure 23:
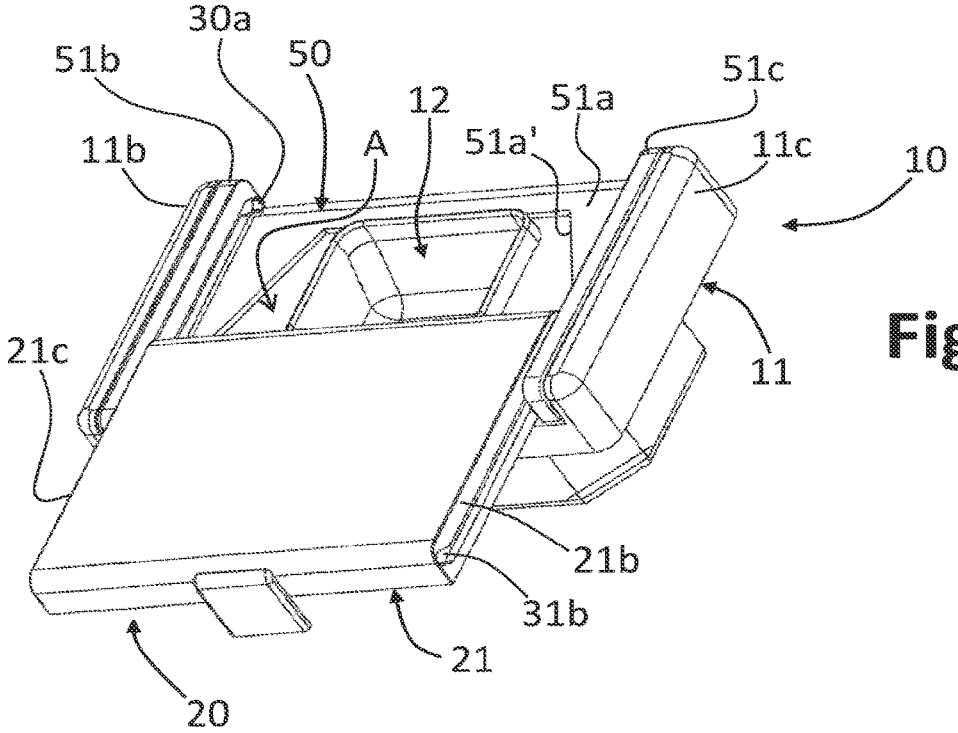

With reference in particular to FIG. 22, in the example illustrated the body 51 of the transmission element 50 has an intermediate portion 51*a* and two side portions or walls 51*b* and 51*c*, where provided on the inner side of these portions 51*b* and 51*c* are a respective guide seat 30*a* and a projecting guide element 31*a* of the type described previously: visible in FIG. 24 is only the inner side of the wall 41*b*. Located, instead, on the outer side of the walls 21*b* and 21*c* of the body 21 of the door 20 are a guided projecting element 30*b* and a guide seat 31*b* of the type described previously: visible in FIG. 22 is only the outer side of the wall 21*c*. The intermediate portion 51*a* that connects the two walls 51*b* and 51*c* to one another is preferably shaped so as not to interfere with the mouth of the receptacle 12: for this purpose, in the example, the portion 51*a* has a recess 51*a*'. Preferably, the portion 51*a* has a thickness smaller than that of the projecting edge 12*a* of the receptacle 12.

Figure 24:
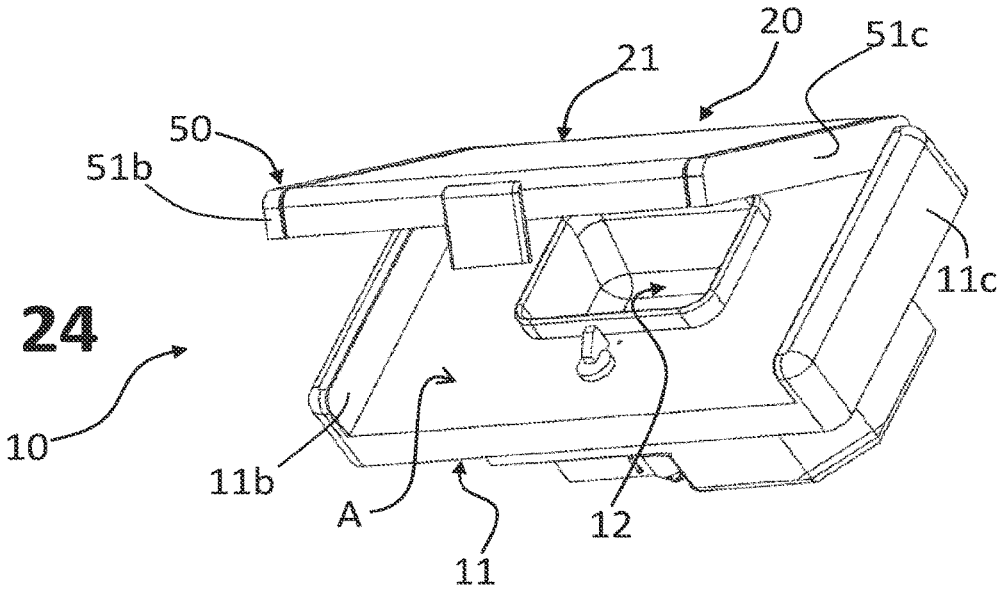

In the example represented, the element 50, i.e., its body 51, is hinged to the body 11, substantially in the area indicated by the arrows Y, in order to be moved angularly and enable a corresponding angular movement of the door 20, as emerges from FIG. 24. The guided sliding of the body 21 with respect to the element 50 is instead obtained according to the modalities already described previously, thanks to the slidable coupling between the guide members and the guided members. From FIGS. 22 and 23 it may be appreciated how, in this embodiment, the inner side of the walls 11*b* and 11*c* of the body 11, on the one hand, and the outer side of the walls 41*b* and 41*c* of the element 40, on the other, may be substantially plane, obviously without considering the presence of the necessary hinging elements in the points Y, such as (see FIG. 22) a hole 52, preferably a blind hole, on the inner sides of the walls 11*b*, 11*c* and a corresponding pin 51*d* projecting on the outer side of the walls 51*b* and 51*c* (or vice versa).

As already mentioned, the parts of the slide guides may be operative between the inner sides of the side walls of the dispenser body and the outer sides of the side walls of the door body or, vice versa, between the outer sides of the side walls of the dispenser body and the inner sides of the side walls of the door body, or again with combinations of the above arrangements, according to the teachings of the international patent application WO/2015001511 A filed in the name of the present Applicant. As explained, the dispenser body or the door body may comprise a fixed or movable connection element, on which respective parts of the slide guides are obtained.

Once again according to the teachings of WO/2015001511 A, in a dispenser according to the present invention, at least one of the dispenser body 11 and the door body 21 may comprise at least one constraint element, which is additional to the walls 11*b* and 11*c* and to the walls 21*b* and 21*c*, where this constraint element is prearranged for limiting displacements of the guided elements 30*b*, 31*b* with respect to the guide elements 30*a*, 31*a* in a direction generally transverse to the direction D of sliding of the door 20.

What has been described previously with reference to the slide guides may be obtained with equivalent techniques, without thereby departing from the scope of the invention. For instance, the functions of the projecting elements could be reversed with respect to those of the seats. In this perspective, the guide parts also defined herein as "projecting elements" could, for example, comprise rails in relief, and consequently the "seats" could comprise a pair of reliefs (defining between them a recessed part), between which the aforesaid rail slides. Likewise, a "seat" could be defined between two rails in relief, slidably engaged by a corresponding "projecting element".

The invention claimed is:

1. A washing agent dispenser for a dishwasher, comprising:

a dispenser body, configured to be set partially into an opening of an inner side of a dishwasher door, the dispenser body having at least one receptacle for containing a washing agent;

at least one dispenser door mounted in a guided way with respect to the dispenser body for being slidable between a position of closing and a position of opening of the at least one receptacle, said position of opening allowing dispensing of the washing agent from the at least one receptacle;

guides between the dispenser body and the dispenser door, for guiding displacement of the dispenser door between the position of closing and the position of opening in such a way that, when the dispenser door is in the position of opening, a portion of the dispenser door projects from the dispenser body, in particular in a substantially cantilever fashion; and at least one supporting element extending in length downwards from the dispenser door and configured to counter bending of said portion of the dispenser door that projects from the dispenser body when the dispenser door is in the position of opening.

2. The washing agent dispenser according to claim 1, wherein the at least one supporting element has a lower end suitable to rest on said inner side of the dishwasher door when a stress is exerted from above on said portion of the dispenser door that projects from the dispenser body when the door is in the position of opening.

3. The washing agent dispenser according to claim 1, wherein the at least one supporting element is in a fixed position relative to the dispenser door.

4. The washing agent dispenser according to claim 1, wherein the at least one supporting element has a surface that faces a wall or portion of the dispenser body both when the dispenser door is in the closed position, and when the dispenser door is in the open position.

5. The washing agent dispenser according to claim 1, wherein the at least one supporting element is associated or defined at an end portion or wall of the dispenser door.

6. The washing agent dispenser according to claim 1, wherein:

two first walls of the dispenser body each have a side facing a side of a respective second wall of the dispenser door;

the guides comprise guiding elements and guided elements at facing sides of the first walls of the dispenser body and of the second walls of the dispenser door, the guided elements being slidably coupled to the guiding elements; and the supporting element is defined by, or associated to, an end wall of the dispenser door that extends between said side walls, said end wall belonging to said portion of the dispenser door that projects from the dispenser body when the dispenser door is in the position of opening.

7. The washing agent dispenser according to claim 4, wherein:

the at least one supporting element is associated or defined at an end portion or wall of the dispenser door; and said end wall or portion of the dispenser body and said wall or portion of the dispenser door are front end walls or portions of the dispenser body and of the dispenser door, respectively, as viewed from a direction of displacement of the dispenser door from the position of closing to the position of opening.

8. The washing agent dispenser according to claim 4, wherein:

the dispenser body has foot part, configured to be set into said opening of the inner side of the dishwasher door, and a head part, designed to protrude with respect to said inner side of the dishwasher door; and said wall or portion of the dispenser body comprises a front wall of the head part of the dispenser body.

9. The washing agent dispenser according to claim 1, wherein:

the dispenser body has an upper face at which the receptacle is defined;

the dispenser door has a lower face facing the upper face of the dispenser body at least when the dispenser door is in position of closing; and the at least one supporting element has a length greater than a distance between said lower face of the dispenser door and said upper face of the dispenser body.

10. The washing agent dispenser according to claim 5, wherein said end portion or wall extends between two side walls of the dispenser door, and the at least one supporting element is located in a position of said end portion or wall that is intermediate with respect to the two side walls.

11. The washing agent dispenser according to claim 1, wherein the at least one supporting element is formed integrally with a component part of the dispenser door.

12. The washing agent dispenser according to claim 1, wherein the dispenser door comprises a number of component parts assembled together.

13. The washing agent dispenser according to claim 1, wherein the at least one supporting element has a substantially flat shape.

14. The washing agent dispenser according to claim 9, wherein:

said upper face of the dispenser body includes an upper projecting edge of the receptacle;

a gasket is mounted at said lower face of the dispenser door; and the guides are configured in such a way that the gasket comes into contact with the upper projecting edge of the receptacle in a final phase of a movement of the dispenser door from the position of opening to the position of closing.

15. The washing agent dispenser according to claim 1, wherein:

the dispenser body has an upper face including an upper projecting edge of the receptacle;

the dispenser door has, at and end region thereof opposite to the at least one supporting element, an end wall including a lower profile which defines a recess, such that said end wall does not interfere with the upper projecting edge of the receptacle during movement of the dispenser door between the position of opening and the position of closing.

16. The washing agent dispenser according to claim 1, wherein:

two first walls of the dispenser body each have a side facing a side of a respective second wall of the dispenser door;

the guides comprise guiding elements and guided elements at facing sides of the first walls of the dispenser body and of the second walls of the dispenser door, the guided elements being slidably coupled to the guiding elements;

one of the dispenser body and the dispenser door comprises a first body element and a second body element configured as separate part with respect to the first body element and associated thereto, the second body element defining at least one of said first walls or said second walls.

17. A washing agent dispenser for dishwashers, comprising:

a dispenser body, configured to be set partially into an opening of an inner side of a dishwasher door, the dispenser body having at least one receptacle for containing a washing agent;

at least one dispenser door mounted in a guided way with respect to the dispenser body for being slidable between a position of closing and a position of opening of the at least one receptacle, said position of opening allowing dispensing of the washing agent from the at least one receptacle; and guides between the dispenser body and the dispenser door, for guiding displacement of the dispenser door between the position of closing and the position of opening in such a way that, when the dispenser door is in the position of opening, a portion of the dispenser door projects from the dispenser body, in particular in a substantially cantilever fashion;

wherein the dispenser door has at least one supporting element that extends downwards in front of a corresponding end wall or portion of the dispenser body;

wherein the at least one supporting element is configured to counter bending of said portion of the dispenser door that projects from the dispenser body when the door is in the position of opening; and wherein the at least one supporting element has a lower end suitable to rest on said inner side of the dishwasher door when a stress is exerted from above on said portion of the dispenser door that projects from the dispenser body.

18. A washing agent dispenser for dishwashers, comprising:

a dispenser body, configured to be set partially into an opening of an inner side of a dishwasher door, the dispenser body having at least one receptacle for containing a washing agent;

at least one dispenser door mounted in a guided way with respect to the dispenser body for being slidable between a position of closing and a position of opening of the at least one receptacle, the dispenser door being urged towards the position of opening via elastic means; and guides between the dispenser body and the dispenser door, for guiding displacement of the dispenser door between the position of closing and the position of opening, in such a way that, when the dispenser door is in the position of opening, a portion of the dispenser door projects from the dispenser body, in particular in a substantially cantilever fashion;

the dispenser moreover comprising a system for blocking/release of the dispenser door, operatively set between the dispenser body and the dispenser door, the system for blocking/release being operable for releasing the dispenser door and enabling passage thereof from the position of closing to the position of opening under action of the elastic means, in order to dispense a washing agent contained in the at least one receptacle;

wherein two first walls of the dispenser body each have a side facing a side of a respective second wall of the dispenser door;

wherein the guides comprise guiding elements and guided elements at facing sides of the first walls of the dispenser body and of the second walls of the dispenser door, the guided elements being slidably coupled to the guiding elements;

wherein for at least one said first wall, or for each said first wall, the guiding elements comprise at least one first seat and at least one first projecting element, both defined in a fixed position in the side of the respective first wall that faces the corresponding side of the corresponding said second wall;

wherein for at least one said second wall, or for each said second wall, the guided elements comprise at least one second projecting element and at least one second seat, both defined in a fixed position in the side of the respective second wall that faces the corresponding side of the corresponding said first wall;

wherein the first projecting element of the first wall, or of each first wall, is engaged in a respective second seat of the corresponding second wall, and the second projecting element of the second wall, or of each second wall, is engaged in a respective first seat of the corresponding first wall;

wherein one of the dispenser body and the dispenser door comprises a first body element and a second body element, the second body element being configured as a separate part with respect to the first body element and associated thereto; and wherein one of said at least one first wall or said at least one second wall belongs to the second body element.

19. The washing agent dispenser according to claim 18, wherein the dispenser door comprises said first body element and said second body element, the second body element defining said at least one second wall including the respective at least one first seat and at least one first projecting element.

20. A household dishwasher, comprising the washing agent dispenser according to claim 1.

* * * * *